US011306510B2

(12) United States Patent
Cheng

(10) Patent No.: US 11,306,510 B2
(45) Date of Patent: Apr. 19, 2022

(54) CYLINDER ASSEMBLY WITH ROTATING WINGED LATCH BOLT FOR SLIDING DOOR LOCKSET

(71) Applicant: Qianyan Cheng, Sacramento, CA (US)

(72) Inventor: Qianyan Cheng, Sacramento, CA (US)

( * ) Notice: Subject to any disclaimer, the term of this patent is extended or adjusted under 35 U.S.C. 154(b) by 272 days.

(21) Appl. No.: 16/746,821

(22) Filed: Jan. 18, 2020

(65) Prior Publication Data

US 2021/0222465 A1 Jul. 22, 2021

(51) Int. Cl.

| | |
|---|---|
| ***E05B 63/12*** | (2006.01) |
| ***E05B 65/08*** | (2006.01) |
| ***E05B 57/00*** | (2006.01) |
| ***E05B 15/00*** | (2006.01) |
| ***E05B 9/00*** | (2006.01) |
| ***E05B 9/08*** | (2006.01) |

(Continued)

(52) U.S. Cl.

CPC ..... *E05B 63/125* (2013.01); *E05B 9/002* (2013.01); *E05B 9/02* (2013.01); *E05B 9/08* (2013.01); *E05B 15/0033* (2013.01); *E05B 15/02* (2013.01); *E05B 57/00* (2013.01); *E05B 63/127* (2013.01); *E05B 65/08* (2013.01); *E05Y 2900/132* (2013.01)

(58) Field of Classification Search

CPC ..... Y10T 292/0867; Y10T 292/096; Y10T 292/0993; Y10T 292/1018; Y10T 292/307; Y10T 292/0843; Y10T 292/0863; Y10T 292/0864; Y10T 292/0886; Y10T 292/0823; E05B 63/125; E05B 9/002; E05B 9/02; E05B 9/08; E05B 15/0033; E05B 15/02; E05B 57/00; E05B 63/127; E05B 65/08

USPC ... 292/137, 172, 142, 279.39, 22, 57, 58, 63

See application file for complete search history.

(56) References Cited

U.S. PATENT DOCUMENTS 585,509 A * 6/1897 Clarke ..... E05B 65/0864 292/60
1,585,089 A * 5/1926 Diskin ..... E05B 63/125 70/128

(Continued)

FOREIGN PATENT DOCUMENTS

CA 2157857 A1 * 3/1996 ..... E05B 63/127
DE 343299 C * 10/1921 ..... E05B 63/125

(Continued)

*Primary Examiner* — Kristina R Fulton
*Assistant Examiner* — Steven A Tullia
(74) *Attorney, Agent, or Firm* — Craig A. Simmermon

(57) ABSTRACT

Cylinder assembly with rotating winged latch bolt for sliding door lockset includes a special latch bolt that holds in an extended position and holds in a retracted position which alternates back and forth by pressing the latch bolt with your finger. The special latch bolt rotates ninety degrees by turning the doorknob, door handle, thumb turn, or coin turn and rotates back ninety degrees by turning the doorknob, door handle, thumb turn, or coin turn back. The special latch bolt has a special winged shape that catches within the strike plate when rotated ninety degrees and releases from the strike plate when rotated ninety degrees back. Also there is a special face plate or cylinder face plate with tabs or notches that serve as a two-position mechanical stop to prevent the latch bolt from over rotating beyond ninety degrees in either direction.

6 Claims, 6 Drawing Sheets

(51) Int. Cl.
*E05B 15/02* (2006.01)
*E05B 9/02* (2006.01)

(56) References Cited

U.S. PATENT DOCUMENTS 1,653,487 A * 12/1927 White ..... E05B 63/125 70/128
1,907,625 A * 5/1933 Vogt ..... E05B 65/0864 70/100
2,235,949 A * 3/1941 Shaw ..... E05F 11/00 292/59
2,376,102 A * 5/1945 Voight ..... E05B 57/00 70/135
2,727,771 A * 12/1955 Adams ..... E05D 15/06 292/17
2,811,765 A * 11/1957 Mathews, Jr. ..... F16B 5/10 411/349
2,958,554 A * 11/1960 Schlage ..... E05B 63/244 292/279
3,386,758 A * 6/1968 Swearingen ..... E05B 63/127 292/53
3,397,000 A * 8/1968 Nakanishi ..... E05B 65/0864 292/61
3,643,296 A * 2/1972 Kahn ..... A44B 1/32 24/108
3,798,935 A * 3/1974 Blekking ..... E05B 65/0864 70/100
3,804,440 A * 4/1974 Carey ..... E05B 63/125 292/58
4,702,095 A * 10/1987 Ben-Asher ..... E05B 47/026 70/279.1
5,761,936 A * 6/1998 Katayama ..... E05B 3/065 292/336.3
6,250,694 B1 * 6/2001 Weiland ..... E05C 19/022 292/110
6,920,770 B2 * 7/2005 Lurie ..... E05B 9/086 70/100
8,517,434 B1 * 8/2013 Reep, Sr. ..... E05B 17/2038 292/65
9,493,967 B2 * 11/2016 Basavarajappa ..... E05B 83/34
2002/0060457 A1 * 5/2002 Roatis ..... E05B 17/0029 292/199
2007/0028657 A1 * 2/2007 Huang ..... E05B 15/02 70/224

FOREIGN PATENT DOCUMENTS

DE 619374 C * 10/1935 ..... E05B 63/125
WO WO-8800637 A1 * 1/1988 ..... E05B 63/125

* cited by examiner

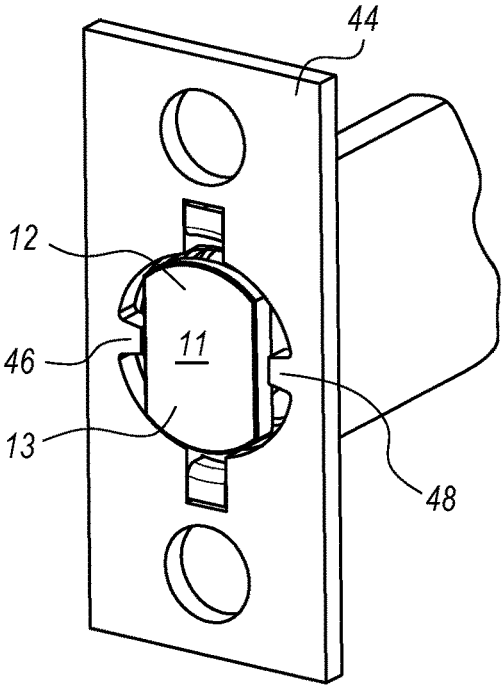
FIG. 12
FIG. 13
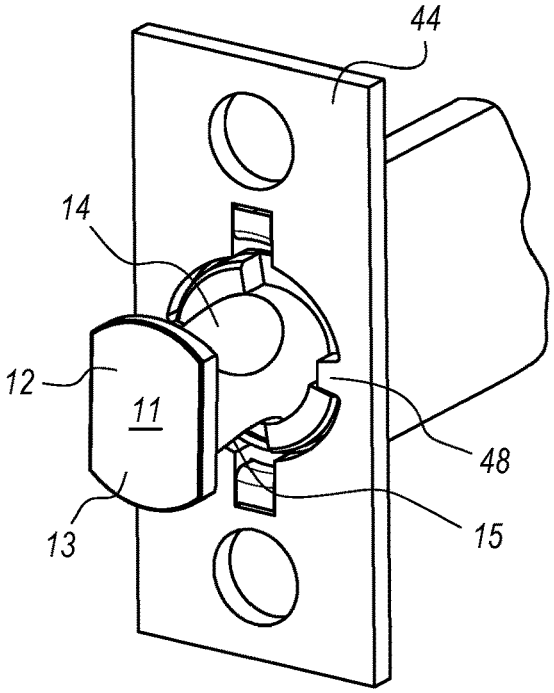
FIG. 14
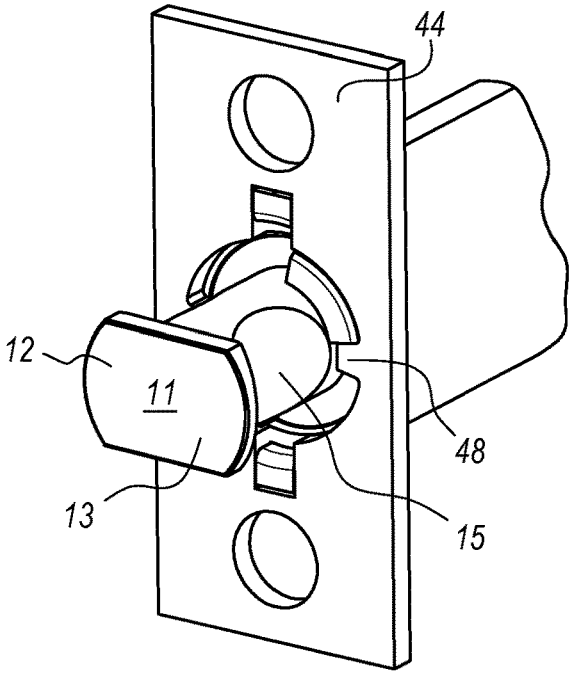

CYLINDER ASSEMBLY WITH ROTATING WINGED LATCH BOLT FOR SLIDING DOOR LOCKSET

BACKGROUND OF THE INVENTION

1. Field of the Invention

This invention relates to a door lockset and specifically to sliding door lockset with a special latch bolt that rotates to lock the sliding door and rotates back to unlock the sliding door. The special latch bolt rotates to catch within the strike plate in the door jamb to lock the sliding door and rotates back to provide clearance between the latch bolt and the strike plate to unlock the sliding door.

2. Description of Related Art

There are many door locksets in the prior art, however, there are none with a special latch bolt that holds in an extended position and also holds in a retracted position by pressing the latch bolt with your finger. The special latch bolt also rotates ninety degrees by turning the doorknob, door handle, thumb turn, or coin turn and rotates back ninety degrees by turning the doorknob, door handle, thumb turn, or coin turn back. The special latch bolt has a special winged shape that catches within the strike plate when rotated ninety degrees and releases from the strike plate when rotated ninety degrees back. The special latch bolt also acts as a handle or edge pull to pull the sliding door out of its pocket in the door jamb. The special latch bolt is located within the latch bolt assembly or tumbler of the lockset, which is different from other locksets in the prior art where the latch bolt is separate from the latch bolt assembly or tumbler. Also, there are no latch bolts in the prior art that are shaped like the one shown and described here and rotate within the strike plate in the door jamb to lock the door and rotate back to unlock the door as shown and described here. This special latch bolt also has a special face plate or cylinder face plate with tabs or notches that serve as a two-position mechanical stop to prevent the latch bolt from over rotating beyond ninety degrees in either direction.

BRIEF SUMMARY OF THE INVENTION

It is an aspect of cylinder assembly with rotating winged latch bolt for sliding door lockset to have a latch bolt assembly that is capable of being installed within a sliding door or a pocket door.

It is an aspect of cylinder assembly with rotating winged latch bolt for sliding door lockset to have a latch bolt assembly that locks the sliding door or pocket door by rotating a doorknob, door handle, thumb turn, or coin turn.

It is an aspect of cylinder assembly with rotating winged latch bolt for sliding door lockset to have a latch bolt assembly that unlocks the sliding door or pocket door by rotating the doorknob, door handle, thumb turn, or coin turn.

It is an aspect of cylinder assembly with rotating winged latch bolt for sliding door lockset to have a latch bolt assembly with a winged latch bolt that rotates when the doorknob, door handle, thumb turn, or coin turn is rotated.

It is an aspect of cylinder assembly with rotating winged latch bolt for sliding door lockset to have a latch bolt assembly with a winged latch bolt that locks in an extended position when the winged latch bolt is pressed inward.

It is an aspect of cylinder assembly with rotating winged latch bolt for sliding door lockset to have a latch bolt assembly with a winged latch bolt that locks in a retracted position when the winged latch bolt is pressed inward.

It is an aspect of winged latch bolt to include a first wing and a second wing which function to catch within a latch bolt hole on a strike plate to lock the sling door or pocket door.

It is an aspect of winged latch bolt to include a first wing and a second wing which function to release from within a latch bolt hole on a strike plate to unlock the sling door or pocket door.

It is an aspect of winged latch bolt to have fixed extended position and a fixed retracted position.

It is an aspect of winged latch bolt to have a fixed vertical position and a fixed horizontal position.

BRIEF DESCRIPTION OF THE DRAWINGS

FIG. 12 is imaginary view where the door face plate has been removed to show the position and orientation of the first and second collar tabs on latch bolt collar and the first and second notches on cylinder face plate with winged latch bolt in the vertical retracted position.

FIG. 13 is imaginary view where the door face plate has been removed to show the position and orientation of the first and second collar tabs on latch bolt collar and the first and second notches on cylinder face plate with winged latch bolt in the vertical extended position.

FIG. 14 is imaginary view where the door face plate has been removed to show the position and orientation of the first and second collar tabs on latch bolt collar and the first and second notches on cylinder face plate with winged latch bolt in the horizontal extended position.

DEFINITION LIST

Figure 1:
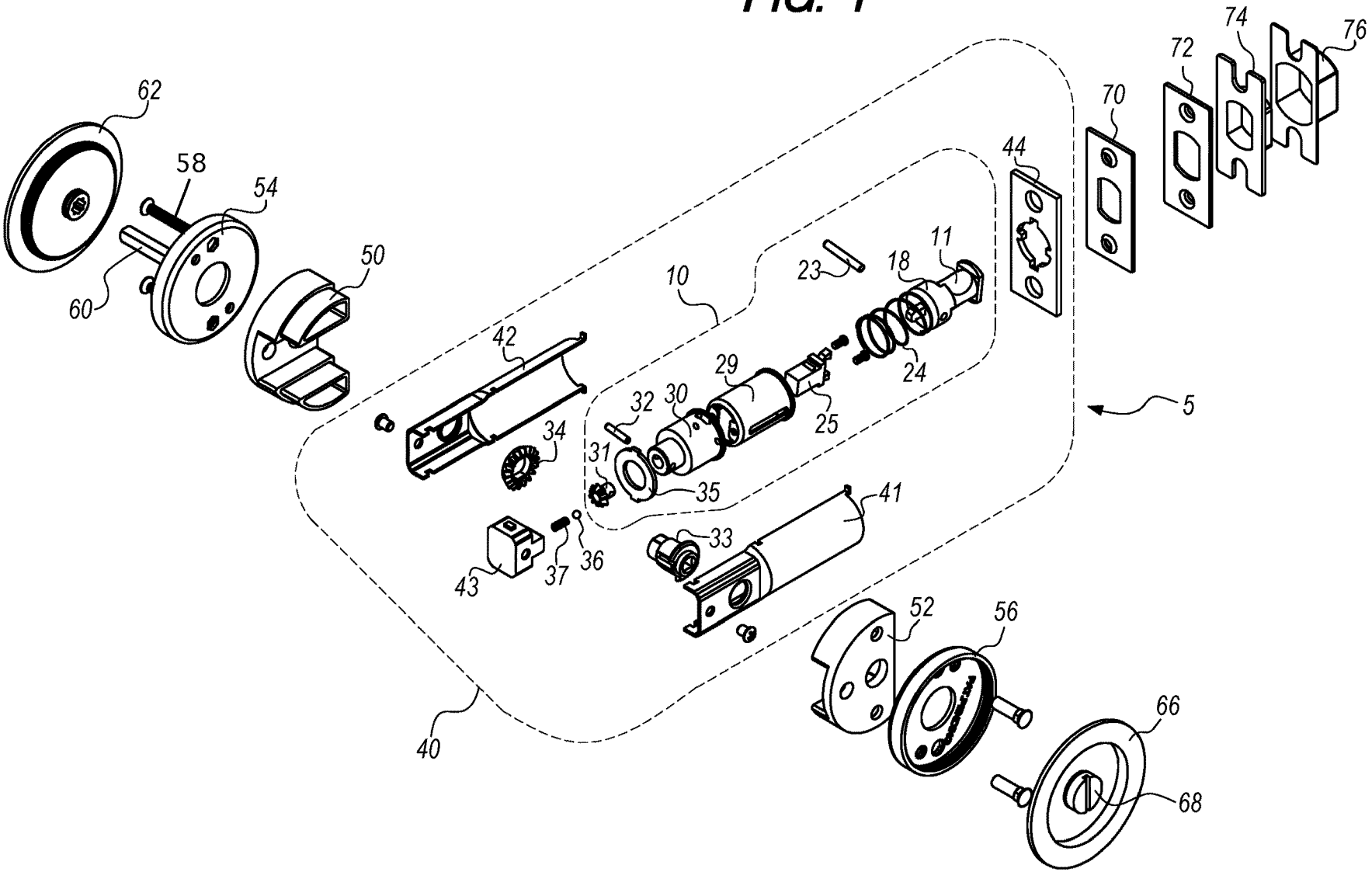
FIG. 1 is an assembly view of sliding door lockset taken from the exterior perspective of the sliding door.
Figure 2:
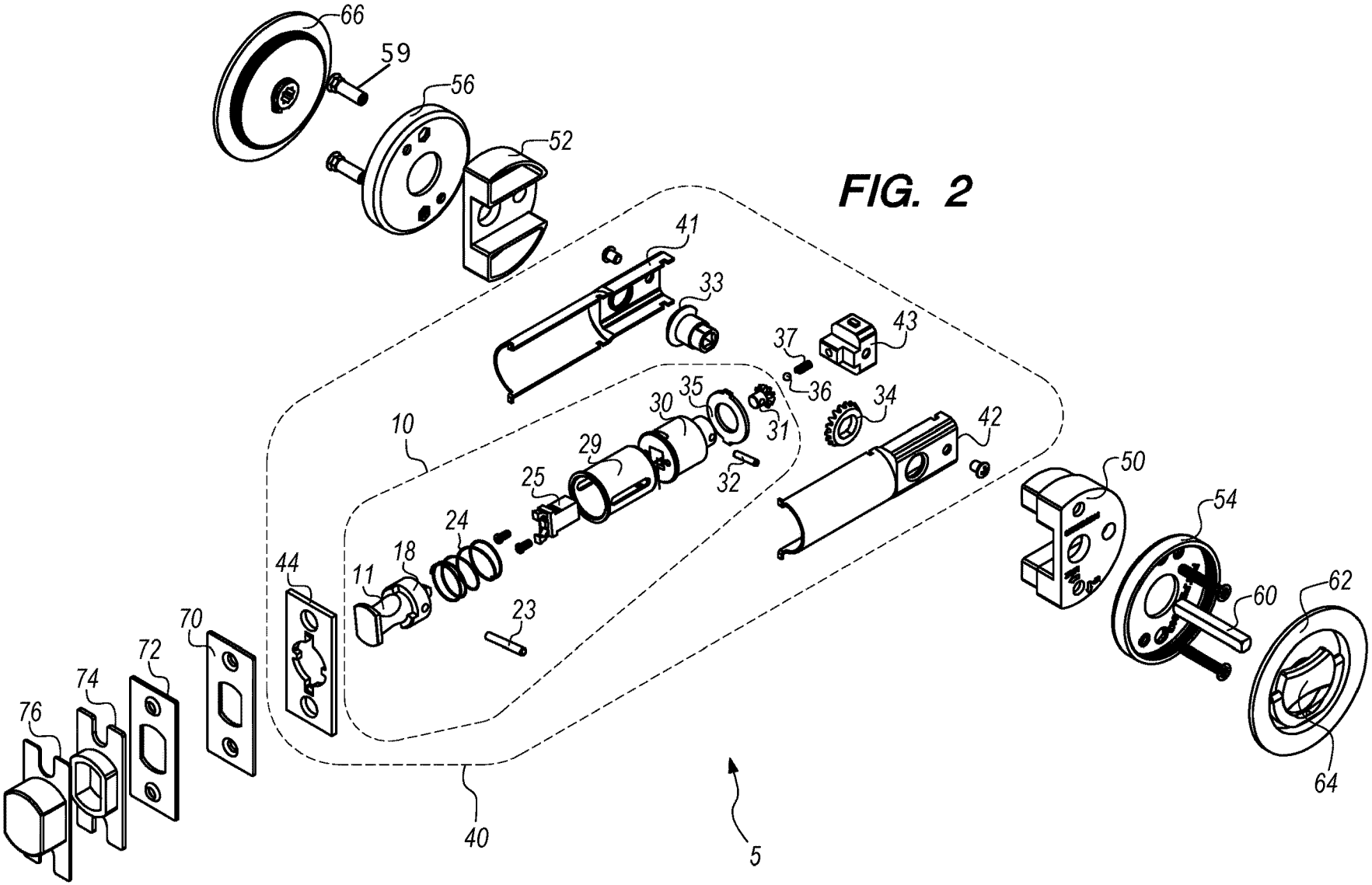
FIG. 2 is an assembly view of sliding door lockset taken from the interior perspective of the sliding door.

| Term | Definition |
|---|---|
| 5 | Sliding Door Cylinder Lockset |

-continued

| Term | Definition |
|---|---|
| 10 | Rotating Winged Latch Bolt Assembly |
| 11 | Winged Latch Bolt |
| 12 | First Wing on Winged Latch Bolt |
| 13 | Second Wing on Winged Latch Bolt |
| 14 | First Notch on Winged Latch Bolt |
| 15 | Second Notch on Winged Latch Bolt |
| 16 | Lock Tongue on Winged Latch Bolt |
| 17 | Pin Hole on Winged Latch Bolt |
| 18 | Latch Bolt Collar |
| 19 | First Collar Tab on Latch Bolt Collar |
| 20 | Second Collar Tab on Latch Bolt Collar |
| 21 | First Pin Hole on Latch Bolt Collar |
| 22 | Second Pin Hole on Latch Bolt Collar |
| 23 | Latch Bolt Collar Pin |
| 24 | Latch Bolt Spring |
| 25 | Latch Bolt Catch |
| 26 | Button on Latch Bolt Catch |
| 27 | First Catch Arm on Latch Bolt Catch |
| 28 | Second Catch Arm on Latch Bolt Catch |
| 29 | Latch Bolt Housing |
| 30 | Latch Bolt Hub |
| 31 | Latch Bolt Gear |
| 32 | Latch Bolt Gear Pin |
| 33 | Spindle Hub |
| 34 | Spindle Hub Gear |
| 35 | Retaining Ring |
| 36 | Ball Bearing |
| 37 | Ball Bearing Spring |
| 40 | Cylinder Assembly with Rotating Winged Latch Bolt |
| 41 | First Cylinder Housing Half |
| 42 | Second Cylinder Housing Half |
| 43 | Cylinder Housing Cap |
| 44 | Cylinder Face Plate |
| 45 | Latch Bolt Hole on Cylinder Face Plate |
| 46 | First Notch on Latch Bolt Hole |
| 48 | Second Notch on Latch Bolt Hole |
| 50 | Male Cylinder Bracket |
| 52 | Female Cylinder Bracket |
| 54 | Interior Rose |
| 56 | Exterior Rose |
| 58 | Screw or Bolt |
| 59 | Nut |
| 60 | Spindle |
| 62 | Interior Trim |
| 64 | Interior Doorknob, Door Handle, or Thumb Turn |
| 66 | Exterior Trim |
| 68 | Exterior Doorknob, Door Handle, or Coin Turn |
| 70 | Door Face Plate |
| 72 | Strike Plate |
| 74 | Sub Strike Plate |
| 76 | Dust Box |

DETAILED DESCRIPTION OF THE INVENTION

Sliding door cylinder lockset 5 is installed into a sliding door (not depicted) or pocket door (not depicted). A pocket door is a sliding door that disappears, when fully open, into a compartment on one side of the door jamb (not depicted). A door jamb is the vertical portion of a door frame on each side of a door frame.

Sliding door cylinder lockset 5 functions to cycle a winged latch bolt 11 through a series of two positions and two orientations. Winged latch bolt 11 has a retracted position and an extended position. Winged latch bolt 11 changes position by pressing the winged latch bolt 11 with your finger to extend and retract it. Winged latch bolt 11 also has a vertical orientation and a horizontal orientation. Winged latch bolt 11 changes orientation or rotates by turning a doorknob, door handle, thumb turn, or coin turn 64,68 to rotate the winged latch bolt 11. By pressing the winged latch bolt 11 and by rotating the doorknob, door handle, thumb turn, or coin turn 64,68, in different combinations, winged latch bolt 11 is cycled through a four position cycle: 1) Vertical Retracted Position, 2) Vertical Extended Position, 3) Horizontal Extended Position, and 4) Vertical Extended Position.

Figure 3:
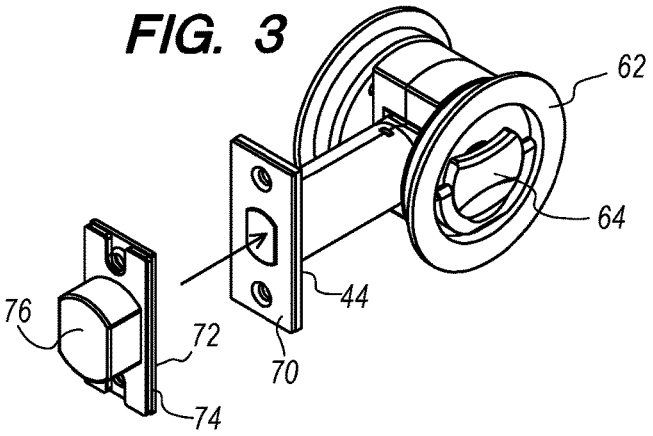
FIG. 3 is a perspective view of sliding door lockset with the sliding door open and the winged latch bolt in the vertical retracted position.

There is a Vertical Retracted Position, depicted in FIG. 3, wherein the winged latch bolt 11 is oriented in a vertical orientation with a first and second wing 12,13 pointing vertically or up and down. The latch bolt is in this position when the sliding door is open and slid into its door pocket. Next is the Vertical Extended Position, depicted in FIG. 4, wherein the winged latch bolt 11 was pressed to cause the winged latch bolt to release from a latch bolt catch 25 to pop-out or extend and hold in the extended position. This is the first step in closing the sliding door where the winged latch bolt 11 is extended to provide a handle with which to pull the sling door out of its pocket. Then the sliding door is slid shut, wherein the winged latch bolt 11 stays in the Vertical Extended Position and is inserted through a strike plate 72 in a door jamb, depicted in FIGS. 5 and 6. To lock the sliding door, winged latch bolt 11 is moved to the Horizontal Extended Position, depicted in FIG. 7, wherein the doorknob, door handle, thumb turn, or coin turn 64,68 is rotated to cause winged latch bolt 11 to rotate ninety degrees to a horizontal orientation with the first and second wing 12,13 pointing horizontally or left and right. In horizontal orientation, winged latch bolt 11 interferes with or collides with the strike plate 72 if/when the sliding door is attempted to be slid open. To unlock the sliding door, winged latch bolt 11 is moved back to the Vertical Extended Position, depicted in FIGS. 5 and 6, wherein the doorknob, door handle, thumb turn, or coin turn 64,68 is rotated back to cause winged latch bolt 11 to rotate back ninety degrees to a vertical orientation with the first and second wing 12,13 pointing vertically or up and down. Then the sliding door is slid open, wherein the winged latch bolt 11 stays in the Vertical Extended Position and exits from the strike plate 72 in the door jamb, depicted in FIG. 4, and the sliding door is returned to its pocket in the wall. Finally, the winged latch bolt 11 is returned to the original Vertical Retracted Position, depicted in FIG. 3, wherein the winged latch bolt 11 is presses inward to cause the latch bolt catch 25 to grab and hold the winged latch bolt 11 in the retracted position.

Rotating winged latch bolt assembly 10 comprises: a winged latch bolt 11; a latch bolt collar 18; a latch bolt collar pin 23; a latch bolt spring 24; a latch bolt catch 25; a latch bolt housing 29; a latch bolt hub 30; and a latch bolt gear 31. Rotating winged latch bolt assembly 10 is a stand-alone subassembly that is preassembled and inserted into the cylinder assembly 40 to create sliding door cylinder lockset 5 as described below.

Winged latch bolt 11 is a latch bolt. Winged latch bolt 11 has a main body or fuselage that is a solid rigid cylindrical member with a first end, an exterior surface, a side, an outside diameter, a length, and a longitudinal axis. The outside diameter of winged latch bolt 11 is sized to make a slip fit with the inside diameter of latch bolt housing 29. There is a first wing 12 protruding outward from the first end of main body or fuselage of winged latched bolt 11. First wing 12 is a rigid protrusion that extends outward from the first end of winged latch bolt 11, at a right angle to the longitudinal axis of the main body or fuselage. First wing 12 has a length, with corresponding longitudinal axis, and a width, with corresponding latitudinal axis. The length dimension and longitudinal axis of first wing 12 extend outward at a right angle to the longitudinal axis of the main body or fuselage. The width dimension and latitudinal axis run perpendicular to the length dimension and tangential to the side of the main body or fuselage. Optionally, winged latch bolt 11 may further comprise a second wing 13 protruding outward from the first end of main body or fuselage of winged latched bolt 11. Second wing 13 is a rigid protrusion that extends outward from the first end of winged latch bolt 11, at a right angle to the longitudinal axis of the main body or fuselage and coincident with the longitudinal axis of first wing 12. Second wing 13 has a length, with corresponding longitudinal axis, and a width, with corresponding latitudinal axis. The length dimension and longitudinal axis of second wing 13 extend outward at a right angle to the longitudinal axis of the main body or fuselage and parallel with the length dimension and longitudinal axis of first wing 12. The width dimension and latitudinal axis run perpendicular to the length dimension and tangential to the side of the main body or fuselage. In best mode, there is a first and second wing as depicted. The rigid protrusions of first and second wings 12,13 each extend outwards from the main body or fuselage to resemble wings extended from the main body or fuselage. When winged latch bolt 11 is in the unlocked or unlatched position, first wing 12 extends vertically upwards and second wing 13 extends vertically downwards. Alternately, as discussed below, the cylinder assembly 40 may be installed in an inverted position, in which case, first wing 12 would extend vertically downwards and second wing 13 would extend vertically upwards. In any event, when winged latch bolt 11 is in the unlocked or unlatched position, the longitudinal axes of first and second wings 12,13 are vertically orientated and are not horizontal.

There may optionally be a first notch 14 adjacent to the first wing 12, toward the second end of winged latch bolt 11, on the exterior surface of winged latch bolt 11. First notch 14 is a notch, gap, void, indentation, or incision in the exterior surface of winged latch bolt 11. First notch 14 may be square or rounded. There may optionally be a second notch 15 adjacent to the second wing 13, toward the second end of winged latch bolt 11, on the exterior surface of winged latch bolt 11. Second notch 15 is a notch, gap, void, indentation, or incision in the surface of winged latch bolt 11. Second notch 15 may be square or rounded. First and second notches 14,15 function to provide additional clearance between the winged latch bolt 11 and the strike plate 72 located in the door jamb when the winged latch bolt 11 is rotated within the strike plate 72 to lock or latch the door.

There is a lock tongue 16 protruding outward from the second end of winged latched bolt 11. Lock tongue 16 is a rigid protrusion with a first end, a second end, and a longitudinal axis. The longitudinal axis of lock tongue 16 is coincident with the longitudinal axis of winged latch bolt 11. The first end of lock tongue 16 is rigidly attached to the second of winged latch bolt 11 at the exterior surface of winged latch bolt 11. The second end of lock tongue 16 has a first tab and a second tab that each protrude outward from the second end of lock tongue 16. Each tab is a rigid planar member that protrudes outward, at a right angle to the longitudinal axis of lock tongue 16. The longitudinal axes of first and second tabs are parallel. The first tab on lock tongue 16 functions to catch within the first catch arm 27 of latch bolt catch 25 when winged latch bolt is in the retracted position as described below. The second tab on lock tongue 16 functions to catch within the second catch arm 28 of latch bolt catch 25 when winged latch bolt is in the retracted position as described below.

There is a pin hole 17 running through the main body or fuselage of winged latch bolt 11, perpendicular to the longitudinal axis of winged latch bolt 11, adjacent to the second end of winged latched bolt 11. Pin hole 17 is a cylindrical hole with an inside diameter running through the center of main body or fuselage of winged latch bolt 11, bisecting the cross section of winged latch bolt 11. Pin hole 17 functions to receive latch bolt collar pin 23, which attaches the latch bolt collar 18 to winged latch bolt 11.

Latch bolt collar 18 is a rigid hollow cylindrical member with a first end, a second end, a side, an inside diameter, an outside diameter, a length, and a longitudinal axis. The outside diameter of latch bolt collar is sized to make a slip fit with the inside diameter of latch bolt housing 29. The first end of latch bolt collar 18 is open and without a closed end to the rigid hollow cylindrical member. The first end of latch bolt collar 18 has a first collar tab 19 and a second collar tab 20.

First collar tab 19 is a portion of the side of rigid hollow cylindrical member that extends beyond its two adjacent side portions to form a crenellation shaped member or square tab member extending from the first end of latch bolt collar 18.

Second collar tab 20 is a portion of the side of rigid hollow cylindrical member that extends beyond its two adjacent side portions to form a crenellation shaped member or square tab member extending from the first end of latch bolt collar 18 that is directly opposite to the first collar tab 19, along the bisect of the latch bolt collar 18.

The second end of latch bolt collar 18 is open and without a closed end to the rigid hollow cylindrical member. The second end of latch bolt collar 18 is straight and flat with any tabs. First and second collar tabs 19,20 function to interfere with, collide with, or butt up against first and second tabs 46,48 on cylinder face plate 44 during rotation of the winged latch bolt 11 and rotating winged latch bolt assembly 10 as described below.

There is a first pin hole 21 adjacent to the second end of latch bolt collar 18. First pin hole 21 is a cylindrical hole through the side of latch bolt collar 18. First pin hole 21 runs radially through the side of the latch bolt collar 18. First pin hole 21 has an inside diameter and a longitudinal axis. There is a second pin hole 22 directly across from the first pin hole 21. Second pin hole 22 is a cylindrical hole through the side of latch bolt collar 18. Second pin hole 22 runs radially through the side of the latch bolt collar 18. Second pin hole 21 has an inside diameter and a longitudinal axis. The longitudinal axis of second pin hole 22 is coincident with that of first pin hole 21. The inside diameters first and second pin holes 21,22 are equal other and to the inside diameter of pin hole 17 in winged latch bolt 11. The inside diameter of latch bolt collar 18 is sized to make a slip fit over the outside diameter of winged latch bolt 11.

Latch bolt collar 18 is attached to winged latch bolt 11 with a latch bolt collar pin 23. Latch bolt collar pin 23 is a solid rigid cylindrical member with a first end, a second end, an outside diameter, and a length. The outside diameter of latch bolt collar pin 23 is sized to make a slip fit or press fit with the inside diameter of pin holes 17,21,22. To attach latch bolt collar 18 to winged latch bolt 11, the first end of latch bolt collar 18 is slid over the second end of winged latch bolt 11 so that the first and second pin holes 21,22 in latch bolt collar 18 are aligned with the two ends of pin hole 17 in winged latch bolt 11, then the latch bolt collar pin is pressed into pin holes 17,21,22 to attach these members together.

Latch bolt spring 24 is a coil spring or helical spring. Latch bolt spring 24 has a first end, a second end, an inside diameter, an outside diameter, a length, and a longitudinal axis. Latch bolt spring 24 functions to apply continuous force that pushes the winged latch bolt 11 outward to continuously push winged latch bolt 11 in the extended position. The outside diameter of latch bolt spring is sized to make a slip fit with the inside diameter of latch bolt housing 29.

Latch bolt catch 25 is a mechanical catch or mechanism that is a stand-alone subassembly that is preassembled and inserted into the latch bolt housing 29 as described below. Latch bolt catch 25 is a means to catch and hold lock tongue 16 when pressed and release lock tongue 16 when pressed again. Latch bolt catch 25 is a means to catch and release lock tongue 16. Latch bolt catch 25 functions to catch and hold winged latch bolt 11 in the retracted position, holding winged latch bolt 11 against the force applied by latch bolt spring 24. Latch bolt catch 25 also functions to release winged latch bolt 11 to allow winged latch bolt 11 to extend to the extended position from the force applied by latch bolt spring 24.

In best mode, latch bolt catch 25 comprises: a button 26, a catch spring, a first catch arm 27, and a second catch arm 28. Latch bolt button 26 is a button or knob that is a rigid member. Latch bolt button 26 has a first end and a second end. Catch spring is coil spring or helical spring. First catch arm 27 is a rigid oblong member with a first end, a second end, and a pivot point located there between. Second catch arm 28 is a rigid oblong member with a first end, a second end, and a pivot point located there between. First and second ends of catch arms 27,28 each pivot around their pivot point. First and second ends of catch arms 27,28 are position in parallel position and separate by a distance so that the first and second ends of catch arms 27,28 form an arrangement that looks like an equals sign. Latch bolt button 26 is located in between first and second catch arms 27,28. The first end of button 26 is adjacent to the first ends of catch arms 27,28. The second end of button 26 is adjacent to the second ends of catch arms 27,28. The second end of button 26 is attached to the second ends of catch arms 27,28 so that these members move together. Catch spring is located adjacent to the second end of button 26 where it applies continuous force pushing button 26 towards outward towards the first end of button 26. When button 26 moves in this direction, since it is connected to the second ends of catch arms 27,28, it rotates the first ends of catch arms 27,28 outwards and away from each other, which releases lock tongue 16 on winged latch bolt 11. When button 26 moves in the opposite direction, it rotates the first ends of catch arms 27,28 inwards and toward each other, which catch onto lock tongue 16 on winged latch bolt 11. With out any contact with lock tongue 16 on winged latch bolt 11, button 26 is pushed outward toward the first ends of catch arms 27,28 by catch spring. When this occurs, winged latch bolt 11 is in the extended position. When lock tongue 16 on winged latch bolt 11 is pressed into button 26, this overcomes the force applied by latch spring, to compress the latch spring and move button 26 towards the second ends of catch arms 27,28, thereby rotating the first ends of catch arms 27,28 inward towards the lock tongue 16. When button 26 is pressed all the way in, the first ends of catch arms 27,28 collapse onto lock tongue 16 to catch and hold lock tongue 16 there between. The first end of catch arm 27 has a tab that interacts with and locks onto the first tab on lock tongue 16. The first end of catch arm 28 has a tab that interacts with and locks onto the second tab on lock tongue 16. When this occurs the latch bolt catch 25 holds the winged latch bolt 11 in the retracted position.

Latch bolt housing 29 is a housing member that houses: winged latch bolt 11, latch bolt collar 18, latch bolt spring 24, and latch bolt catch 25. Latch bolt housing 29 is a rigid hollow cylindrical member with a first end, a side, a second end, an inside diameter, an outside diameter, a length, and a longitudinal axis. The side of latch bolt housing 29 has a first slot and a second slot. Each slot is a slot, channel, or oblong void running longitudinally along the side of latch bolt housing 29. Each slot has a length and a width. First and second slots have equal lengths and widths. The length of each slot is sized to match the travel length of winged latch bolt 11 between the retracted and extended positions. The width of each slot is sized to make a slip fit with the outside diameter of latch bolt collar pin 23. Second slot is located directly opposite to first slot, along the bisect of latch bolt housing 29. First and second slots function as a guide winged latch bolt 11 wherein the first end of latch bolt collar pin 23 extends slightly through the first slot on latch bolt housing 29 and the second end of latch bolt collar pin 23 extends slightly through the second slot on latch bolt housing 29.

Latch bolt hub 30 is a hub member or central part of a wheel that rotates about its center. Latch bolt hub 30 is rigid disc shaped member or cylindrical shaped member with a first end, a second end, a diameter, a center, and a longitudinal axis. Latch bolt hub 30 functions to rigidly attached or connect the second end of latch bolt housing 29 to the first side of latch bolt gear 31. The second side of latch bolt hub 30 has a pin hole running along the diameter of latch bolt hub 30. Pin hole is a cylindrical hole with an inside diameter running through the center of latch bolt hub 30, bisecting the cross section of latch bolt hub 30. Pin hole functions to receive latch bolt gear pin 32, which attaches the latch bolt gear 31 to latch bolt hub 30.

Latch bolt gear 31 is a gear or cogwheel that is a cylindrical shaped rotating machine part with teeth or ridges that project radially outward along its circumference that function to mesh, mate, or couple with teeth or ridges on another gear to transmit torque thereto. Latch bolt gear 31 meshes, mates, or couples with spindle hub gear 34 and functions to transmit torque from spindle 60 to rotating winged latch bolt assembly 10. Latch bolt gear 31 has a first side, a second side, a diameter, a center, and a center axis running perpendicular to the first and second sides. The first side of latch bolt gear 31 has a pin hole running along the diameter of latch bolt gear 31. Pin hole is a cylindrical hole with an inside diameter running through the center of latch bolt gear 31, bisecting the cross section of latch bolt gear 31. Pin hole functions to receive latch bolt gear pin 32, which attaches the latch bolt gear 31 to latch bolt hub 30. The second side of latch bolt gear 31 has plurality of teeth or ridges projected radially along its circumference.

Latch bolt gear pin 32 is a solid rigid cylindrical member with a first end, a second end, an outside diameter, and a length. The outside diameter of latch bolt gear pin 32 is sized to make a slip fit or press fit with the inside diameter of the pin holes on latch bolt hub 30 and latch bolt gear 31.

Rotating winged latch bolt assembly 10 is assembled as follows. The second end of latch bolt housing 29 is aligned with the first end of latch bolt hub 30 so that the longitudinal axis of latch bolt housing 29 is coincident with the center of latch bolt hub 30 and the longitudinal axis of latch bolt hub 30 wherein the two members are rigidly attached together in this formation. Rigid attachment may be accomplished by any known means such as: pressed seam, weld, glue, epoxy, adhesive, bolts, screws, rivets, clips, or snaps. Next, latch bolt catch 25 is inserted into the first end of latch bolt housing 29 and inserted all the way into latch bolt housing 29 until it contacts the first side of latch bolt hub 30. Latch bolt catch 25 is oriented to that its first and second catch arms 27,28 are facing the first end of latch bolt housing 29. Latch bolt catch 25 is rigidly attached to the first side of latch bolt hub 30. Then the second end of latch bolt spring 24 is inserted into the first end of latch bolt housing 29 and inserted all the way into latch bolt housing 29 until it contacts the first side of latch bolt hub 30. Next, the second end of latch bolt collar 18 is inserted into the first end of latch bolt housing 29 and inserted all the way into latch bolt housing 29 until it contacts the first end of latch bolt spring 24. Then the second end of winged latch bolt 11 is inserted into the first end of latch bolt collar 18 and positioned so that both ends of pin hole 17 on winged latch bolt 11 are each aligned with the first and second pin holes 21,22 on latch bolt collar 18, which are also aligned with the first and second slots on latch bolt housing 29, whereupon the latch bolt collar pin 23 is inserted through all pin holes to attach the latch bolt collar 18 to the winged latch bolt 11. As stated, first and second ends of latch bolt collar pin 23 extend slightly into first and second slots on latch bolt housing 29 to act as a guide and guide stop to the sliding action of winged latch bolt 11 sliding from the extended position to the retracted position and back, over and over again. Next, the first side of latch bolt gear 31 is aligned with the second end of latch bolt hub 30 so that their longitudinal axes and centers are coincident and the pin hole in latch bolt gear 31 is aligned with the pin hole in latch bolt hub 30. Finally, the latch bolt gear pin 32 is inserted through and pressed into these pin holes to attach these members together. Whereupon, the rotating winged latch bolt assembly 10 or subassembly is assembled. Note that the rigid attachment of latch bolt hub 30 to latch bolt housing 29 on one end and to latch bolt gear 31 on the other end creates a rigid assembly where the rotation of latch bolt gear 31 also and necessarily rotates the latch bolt housing 29.

Cylinder assembly with rotating winged latch bolt 40 comprises: a rotating winged latch bolt assembly 10; a spindle hub 33; a spindle hub gear 34; a retaining ring 35; a first cylinder housing half 41; a second cylinder housing half 42; a cylinder housing cap 43; and a cylinder face plate 44.

Spindle hub 33 is a hub member or central part of a wheel that rotates about its center. Spindle hub 33 functions to connect or mechanically link latch bolt gear 31 to a spindle 60. Spindle hub 33 is rigid cylindrical shaped member with a first end, a second end, a side, a diameter, a center, and a longitudinal axis. Spindle hub has a spindle keyhole. Spindle keyhole has a longitudinal axis that is coincident with that of spindle hub 33. Spindle keyhole is a keyhole or square hole with a square or rectangular shaped cross section. Spindle keyhole functions as a receiver for the spindle 60, which functions as a key or wrench that forms a slip-fit within spindle keyhole so that the spindle hub 33 will rotate as spindle 60 is rotated.

Spindle hub gear 34 is a gear or cogwheel that is a cylindrical shaped rotating machine part with teeth or ridges that project radially outward along its circumference that function to mesh, mate, or couple with teeth or ridges on another gear to transmit torque thereto. Spindle hub gear 34 meshes, mates, or couples with latch bolt gear 31 and functions to transmit torque from spindle 60 to rotating winged latch bolt assembly 10. Spindle hub gear 34 has a first side, a second side, a diameter, a center, and a center axis running perpendicular to the first and second sides. The second side of the spindle hub gear 34 has plurality of teeth or ridges projecting radially along its circumference. These teeth or ridges mesh with or couple with the teeth or ridges on the second side of latch bolt gear 31. When properly installed within the cylinder assembly with rotating winged latch bolt 40, the center axis of spindle hub gear 34 runs perpendicular to that of the latch bolt gear 31. Thus, spindle hub gear 34 and latch bolt gear 31 mesh, mate, or couple together at a right angle to each other. The diameter of spindle hub gear 34 should be equal to or greater than that of latch bolt gear 31.

Retaining ring 35 is a rigid ring shaped member or rigid annular shaped member with an inside diameter and an outside diameter. Retaining ring 35 functions to retain rotating winged latch bolt assembly 10 within first and second cylinder housing halves 41,41.

First cylinder housing half 41 is one half of a rigid hollow cylindrical member split longitudinally down the center. First cylinder housing half 41 is a housing member that pairs with second cylinder housing half 42 to form a complete cylindrical shaped housing for cylinder assembly with rotating winged latch bolt 40. First cylinder housing half 41 has a first end, a second end, an inside diameter, an outside diameter, a length, and a longitudinal axis. The inside diameter of first cylinder housing half 41 is sized slightly larger than the outside diameter of latch bolt housing 29 because the latch bolt housing 29 must freely rotate within first and second cylinder housing halves 41,42. First cylinder housing half 41 has a screw hole. Screw hole is a clearance hole for a screw to pass through that functions to hold first cylinder housing half 41 onto the cylinder housing cap 43. Screw hole is located adjacent to the second end of first cylinder housing half 41. First cylinder housing half 41 has a spindle clearance hole. Spindle clearance hole is a clearance hole for spindle 60, to allow free rotation of spindle 60 without contact with first cylinder housing half 41. Spindle clearance hole is located in between the first end and the screw hole. Spindle clearance hole has a diameter and a center.

Second cylinder housing half 42 is one half of a rigid hollow cylindrical member split longitudinally down the center. Second cylinder housing half 42 is a housing member that pairs with first cylinder housing half 41 to form a complete cylindrical shaped housing for cylinder assembly with rotating winged latch bolt 40. Second cylinder housing half 42 has a first end, a second end, an inside diameter, an outside diameter, a length, and a longitudinal axis. The inside diameter of second cylinder housing half 42 is sized slightly larger than the outside diameter of latch bolt housing 29 because the latch bolt housing 29 must freely rotate within first and second cylinder housing halves 41,42. Second cylinder housing half 42 has a screw hole. Screw hole is a clearance hole for a screw to pass through that functions to hold second cylinder housing half 42 onto the cylinder housing cap 43. Screw hole is located adjacent to the second end of second cylinder housing half 42. Second cylinder housing half 42 has a spindle clearance hole. Spindle clearance hole is a clearance hole for spindle 60 to allow free rotation of spindle 60 without contact with first cylinder housing half 41. Spindle clearance hole is located in between the first end and the screw hole. Spindle clearance hole has a diameter and a center.

Cylinder housing cap 43 is a rigid cap member. Cylinder housing cap 43 is a rigid disc-shaped, circular-shaped, square-shaped, or rectangular-shaped member with an interior surface, an exterior surface, and a center. Cylinder housing cap 34 has a first edge, a second edge, a third edge, and a fourth edge. First and third edges each have a tapped hole therein that each function to receive a screw used to assemble cylinder assembly with rotating winged latch bolt 40.

Cylinder face plate 44 is a face plate for a lockset. Cylinder face plate 44 is a rigid vertical rectangular-shaped planar member with an exterior surface, an interior surface, a center, an upper edge, a lower edge, a first edge, a second edge, a latch bolt hole 45, a first screw hole, and a second screw hole. Latch bolt hole 45 is a hole or void through the center of the rigid vertical planar member. Latch bolt hole has a center. Latch bolt hole 45 functions to provide a clearance space in the cylinder assembly with rotating winged latch bolt 40 for the winged latch bolt 11 to extend and retract there through. Latch bolt hole 45 has a radiused or curved side or edge. Latch bolt hole 45 has a first tab 46 and a second tab 48. First tab 46 is a rigid planar protrusion that extends inward from the side or edge of latch bolt hole 45 and protrudes inward from the side or edge of latch bolt hole 45. First tab 46 has a width and height. First tab 46 is located at the point on the side or edge of latch bolt hole 45 that is closest to the first edge of cylinder face plate 44. First tab 46 functions to provide a mechanical stop or abutment for first collar tab 19 on latch bolt collar 18. Second tab 47 is a rigid planar protrusion that extends inward from the side or edge of latch bolt hole 45 and protrudes inward from the side or edge of latch bolt hole 45. Second tab 47 has a width and height. Second tab 47 is located at the point on the side or edge of latch bolt hole 45 that is closest to the second edge of cylinder face plate 44, and thus directly opposite from first tab 46, wherein first and second tabs 46,47 both lie on a horizontal plane running through the center of cylinder face plate 44. Second tab 47 functions to provide a mechanical stop or abutment for second collar tab 20 on latch bolt collar 18. First screw hole is a clearance hole for a screw to pass through that functions to hold the door face plate 70 onto the cylinder assembly with rotating winged latch bolt 40. First screw hole is located above latch bolt hole 45. Second screw hole is a clearance hole for a screw to pass through that functions to hold the door face plate 70 onto the cylinder assembly with rotating winged latch bolt 40. Second screw hole is located below latch bolt hole 45.

Cylinder assembly with rotating winged latch bolt 40 is assembled as follows. First cylinder housing half 41 is placed on a horizontal support surface with the concave surface facing upwards. Then spindle hub 33 is rigidly attached to spindle hub gear 34 wherein the second side of latch bolt gear 31 is adjacent to the first side of spindle hub 33 and the center axes of latch bolt gear 31 and spindle hub 33 are coincident. Rigid attachment may be accomplished by any known means such as: pressed seam, weld, glue, epoxy, adhesive, bolts, screws, rivets, clips, or snaps. With this rigid attachment, spindle hub 33 and latch bolt gear 31 form a large cylinder shaped assembly with spindle hub 33 on one end and latch bolt gear 31 on the other end. Spindle hub 33 and spindle hub gear 34 are then positioned into the concave section of first cylinder housing half 41 with the longitudinal axes of latch bolt gear 31 and spindle hub 33 coincident with the center of spindle clearance hole on first cylinder housing half 41. Thus, the center axes of latch bolt gear 31 and spindle hub 33 are perpendicular to the longitudinal axes of first and second cylinder housing halves 41,42. Next, cylinder housing cap is positioned on the second end of first cylinder housing half 41 with the interior surface of cylinder housing cap 43 facing the first end of first cylinder housing half 41 and the exterior surface of cylinder housing cap 43 is flush with the second end of first cylinder housing half 41. Alternately, a ball bearing 36 and a ball bear spring 37 may be included and installed between the interior surface of cylinder housing cap 43 and the rotating side of spindle hub 33 as depicted. Ball bearing 36 is a ball bearing or a rigid spherical member. Ball bear spring 37 is a coil spring or helical spring. The ball bearing 36 and a ball bear spring 37 function as a bearing between the rotating side of spindle hub 33 and the stationary cylinder housing cap 43 to allow for easier and more dependable rotation or pivotal motion between these members. The spindle hub 33 rotates with the spindle 60 as the spindle 60 is rotated. Now, the rotating winged latch bolt assembly 10 is installed into first cylinder housing half 41 with winged latch bolt 11 in the vertical retracted position. First, the retaining ring 35 is positioned over the end of rotating winged latch bolt assembly 10 with the attached latch bolt hub 30 and attached latch bolt gear 31. Then, the latch bolt gear 31 is positioned adjacent to spindle hub gear 34 and married to spindle hub gear 34 so that the teeth or ridges of latch bolt gear 31 are weaved or meshed into or entwined with the teeth or ridges on the spindle hub gear 34 wherein the retaining ring 35 also slides into a groove in the interior surface of first cylinder housing half 41. As stated, these gears 31,32 are weaved or meshed together at right angles to each other. Retaining ring 35 functions to hold and retain rotating winged latch bolt assembly 10 from lateral movement within first and second cylinder housing halves 41,42. Retaining ring 35 allows rotational movement between rotating winged latch bolt assembly 10 and the first and second cylinder housing halves 41,42 but does not allow the rotating winged latch bolt assembly 10 to slide back and forth within the first and second cylinder housing halves 41,42. Next, the second cylinder housing half 42 is positioned on the first cylinder housing half 41 with the first ends of each adjacent to each other and the second ends of each adjacent to each other. Then a screw or bolt is used to fasten the first cylinder housing half 41 to the tapped hole on the first edge of cylinder housing cap 43 and another screw or bolt is used to fasten the second cylinder housing half 42 to the tapped hole on the third edge of cylinder housing cap 43. Next, cylinder face plate 44 is positioned over the first ends of first and second cylinder housing halves 41,42 so that the center of latch bolt hole 45 is coincident with the longitudinal axis of winged latch bolt 11 with the first collar tab 19 on latch bolt collar 18 weaved between the first and second tabs 46,48 on cylinder face plate 44 and the second collar tab 20 on latch bolt collar 18 weaved between the first and second tabs 46,48 on cylinder face plate 44. Then, the cylinder face plate 44 is rigidly attached to the first ends of first and second cylinder housing halves 41,42. Rigid attachment may be accomplished by any known means such as: pressed seam, weld, glue, epoxy, adhesive, bolts, screws, rivets, clips, or snaps.

Sliding door cylinder lockset 5 comprises: a cylinder assembly with rotating winged latch bolt 40; a male cylinder bracket 50; a female cylinder bracket 52; an interior rose 54; an exterior rose 56; a spindle 60; an interior trim 62; an interior doorknob, door handle, or thumb turn 64; an exterior trim 66; an exterior doorknob, door handle, or coin turn 68; a door face plate 70; and a strike plate 72.

Male cylinder bracket 50 is a bracket that holds the cylinder assembly with rotating winged latch bolt 40 within the sliding door. Male cylinder bracket 50 is a rigid member with an inner side, an outer side, and a center hole. Female cylinder bracket 52 is a bracket that mates with the male cylinder bracket 50 and holds cylinder assembly with rotating winged latch bolt 40 within a sliding door. Female cylinder bracket 52 is a rigid member with an inner side, an outer side, and a center hole. Male cylinder bracket 50 and female cylinder bracket 52 function to mount the lock cylinder onto the sliding door. Male cylinder bracket 50 and female cylinder bracket 52 are common to every cylinder lockset.

Spindle 60 is a spindle for a lockset. Spindle 60 is a rigid solid rectangular cuboid member with a first end, a second end, and a longitudinal axis.

Interior rose 54 is a rigid planar member with an inner side, an outer side, and a center hole. Exterior rose 56 is a rigid planar member with an inner side, an outer side, and a center hole.

Interior trim 62 is a rigid planar member with an inner side, an outer side, and a center hole. Exterior trim 66 is a rigid planar member with an inner side, an outer side, and a center hole.

Interior doorknob, door handle, or thumb turn 64 is a doorknob, door handle, or thumb turn for a lockset. Exterior doorknob, door handle, or coin turn 68 is a doorknob, door handle, or thumb turn for a lockset.

Door face plate 70 is a face plate for a door. Door face plate 70 is a rigid planar member with a latch bolt hole in the center. Latch bolt hole has a width and a height. The height of latch bolt hole is larger than its width. The height of latch bolt hole in door face plate 70 is greater than the distance from the tip of the first wing 12 to the tip of the second wing 13 on winged latch bolt 11. The width of latch bolt hole in door face plate 70 is less than the distance from the tip of the first wing 12 to the tip of the second wing 13 on winged latch bolt 11.

Strike plate 72 is a strike plate for a door jamb. Strike plate 72 is a rigid planar member with a latch bolt hole in the center. Latch bolt hole has a width and a height. The height of latch bolt hole is larger than its width. The height of latch bolt hole in strike plate 72 is greater than the distance from the tip of the first wing 12 to the tip of the second wing 13 on winged latch bolt 11. The width of latch bolt hole in strike plate 72 is less than the distance from the tip of the first wing 12 to the tip of the second wing 13 on winged latch bolt 11.

To install cylinder assembly with rotating winged latch bolt 40 within a sliding door, the cylinder assembly with rotating winged latch bolt 40 is slid into a cavity in the sliding door. This cavity is a standard and customary cavity that must be made inside any door to install a cylinder lockset. Next the inner side of male cylinder bracket 50 is positioned over the second cylinder housing half 42 on cylinder assembly with rotating winged latch bolt 40 and the inner side of female cylinder bracket 52 is positioned over the first cylinder housing half 41 on cylinder assembly with rotating winged latch bolt 40 to clamp around or sandwich the cylinder assembly with rotating winged latch bolt 40. Then the inner side of interior rose 54 is placed against the outer side of male cylinder bracket 50 so that the center holes of these members are concentric. The inner side of exterior rose 56 is placed against the outer side of female cylinder bracket 52 so that the center holes of these members are concentric. Then two screws or bolts 58 are installed through the interior rose 54 and the male cylinder bracket 50 to mate with two nuts 59 are installed through the exterior rose 56 and female cylinder bracket 52, as depicted, to attach these members to the sliding door. The first end of spindle 60 is inserted through the center hole of interior rose 54, inserted through the spindle keyhole on spindle hub gear 34, and out of the center hole on exterior rose 56. Alternately, The first end of spindle 60 is inserted through the center hole of exterior rose 56, inserted through the spindle keyhole on spindle hub gear 34, and out of the center hole on interior rose 54. Then interior doorknob, door handle, or thumb turn 64, exterior trim 66, exterior doorknob, door handle, or coin turn 68, and door face plate 70 are assembled and installed within a sliding door in the usually manner. Door face plate 70 is installed within the sliding door jamb in the usual manner. Strike plate 72 is installed within the sliding door jamb in the usual manner.

Sliding door cylinder lockset 5 may further comprise: a sub strike plate 74 and a dust box 76. In this case, sub strike plate 74 and a dust box 76 are installed within the sliding door jamb in the usual manner.

Sliding door cylinder lockset 5 is operated as follows.

Figure 8:
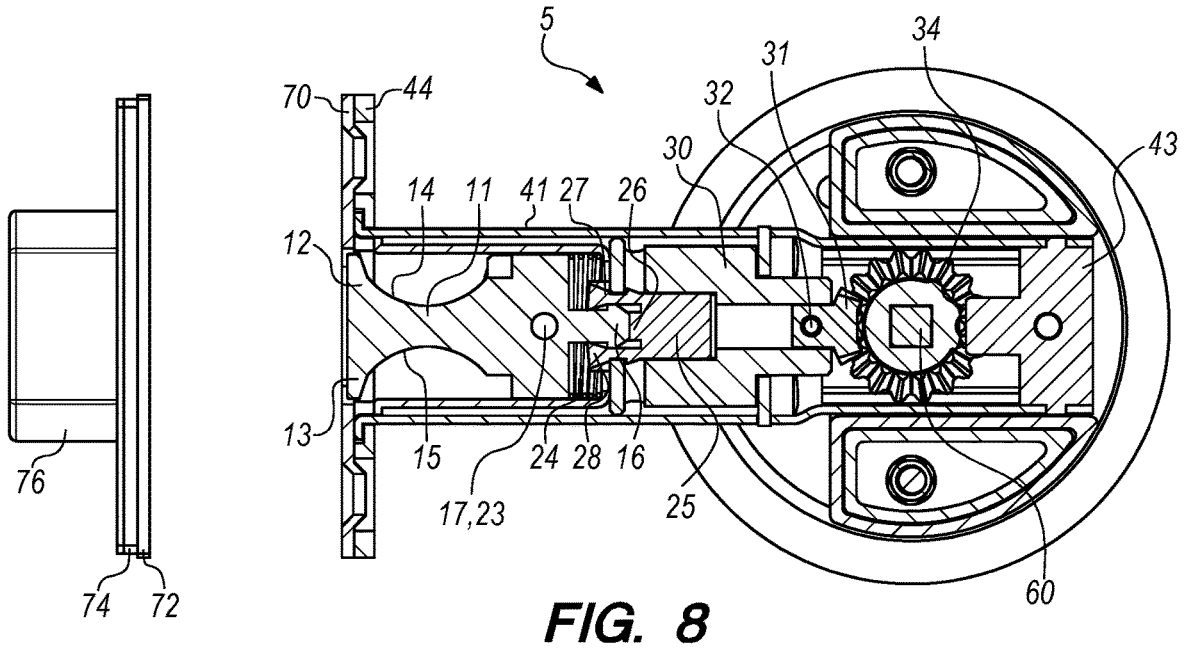
FIG. 8 is a cross sectional view of FIG. 3.

In the open position, the sliding door is open and slid into its pocket in the door jamb that is located opposite from the door jamb with the strike plate 72. In the open position, the winged latch bolt is kept in the retracted vertical position. This position is depicted in FIGS. 3 and 8. As shown, the door face plate 70 and the strike plate 72 are separated because the sliding door is open. FIG. 12 also depicts this position, but in an imaginary view where the door face plate 70 has been removed to show the position and orientation of the first and second collar tabs 19,20 on latch bolt collar 18 and the first and second tabs 46,48 on cylinder face plate 44.

Figure 4:
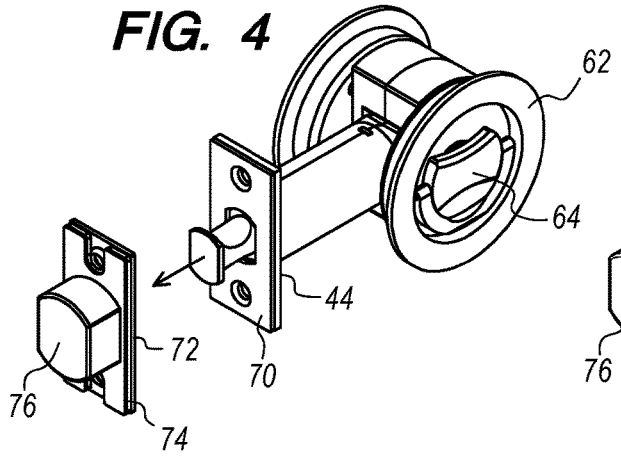
FIG. 4 is a perspective view of sliding door lockset with the sliding door open and the winged latch bolt in the vertical extended position.
Figure 9:
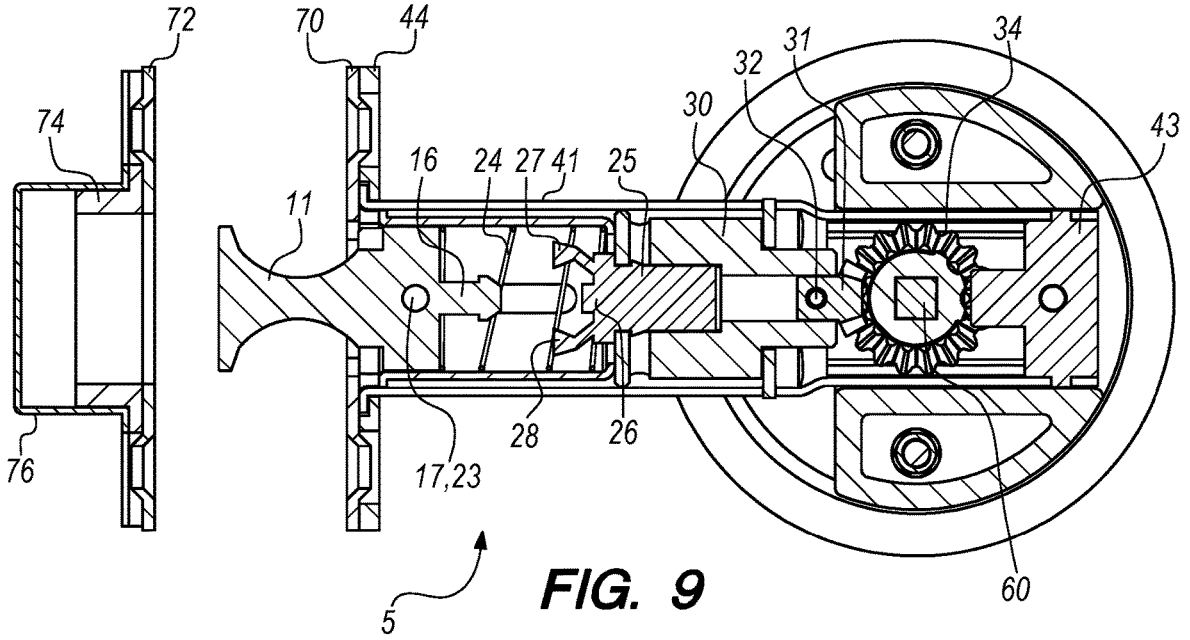
FIG. 9 is a cross sectional view of FIG. 4.

To start closing the door, the first end of winged latch bolt 11 is pressed to push the winged latch bolt 11 slightly inward, which releases the lock tongue 16 from the latch bolt catch 25 and causes the winged latch bolt 11 to extend outward. Winged latch bolt 11 is retained and prevented form flying completely out of the cylinder assembly with rotating winged latch bolt 40 by both ends of latch bolt collar pin 23 catching on the first ends of first and second slots on latch bolt housing 29. This position is depicted in FIGS. 4 and 9. As shown, the door face plate 70 and the strike plate 72 are separated because the sliding door is open. FIG. 13 also depicts this position, but in an imaginary view where the door face plate 70 has been removed to show the position and orientation of the first and second collar tabs 19,20 on latch bolt collar 18 and the first and second tabs 46,48 on cylinder face plate 44.

Figure 6:
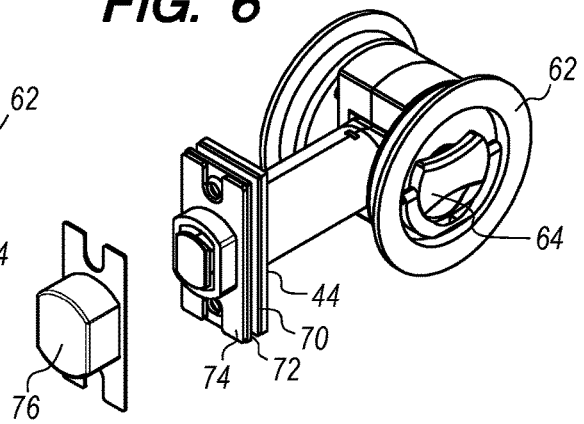
FIG. 6 is an imaginary view of FIG. 5 with the dust box separated from the strike plate showing the position and orientation of the strike plate relative to the winged latch bolt in vertical extended position.
Figure 5:
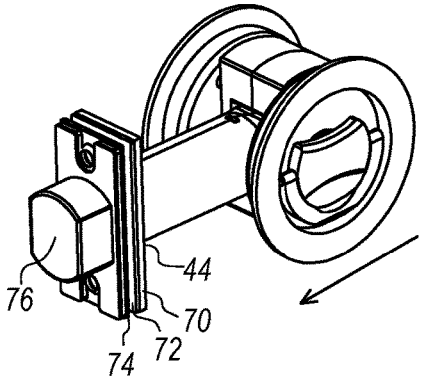
FIG. 5 is a perspective view of sliding door lockset with the sliding door closed and the winged latch bolt in the vertical extended position.
Figure 10:
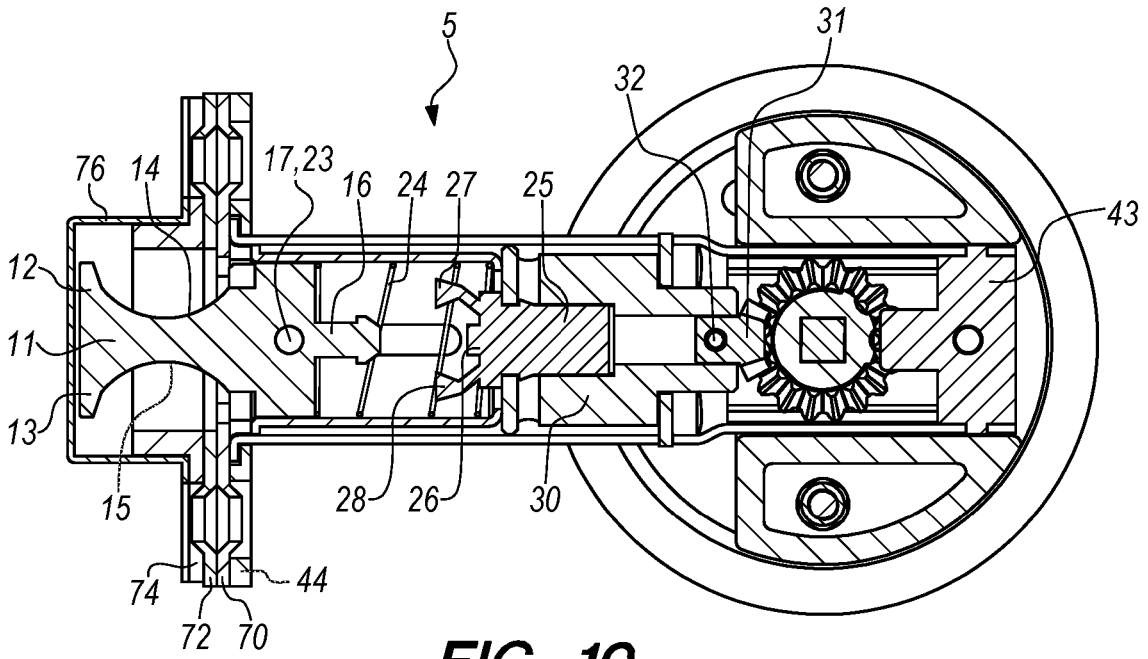
FIG. 10 is a cross sectional view of FIG. 5.

Next, the sliding door is slid closed to contact the door jamb with the strike plate 72. This position is depicted in FIGS. 5 and 10. As shown, the door face plate 70 and the strike plate 72 are adjacent and in contact with each other because the sliding door is closed. FIG. 6 also depicts this position, but in an imaginary view where the dust box 76 has been separated from the strike plate 72 to show the position and orientation of the strike plate 72 and the winged latch bolt 11. FIG. 13 also depicts this position, but in an imaginary view where the door face plate 70 has been removed to show the position and orientation of the first and second collar tabs 19,20 on latch bolt collar 18 and the first and second tabs 46,48 on cylinder face plate 44.

Figure 7:
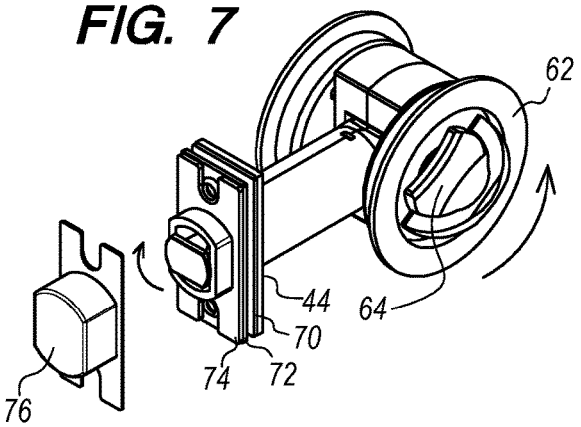
FIG. 7 is imaginary view with the dust box separated from the strike plate to show the position and orientation of the strike plate relative to the winged latch bolt in horizontal extended position.
Figure 11:
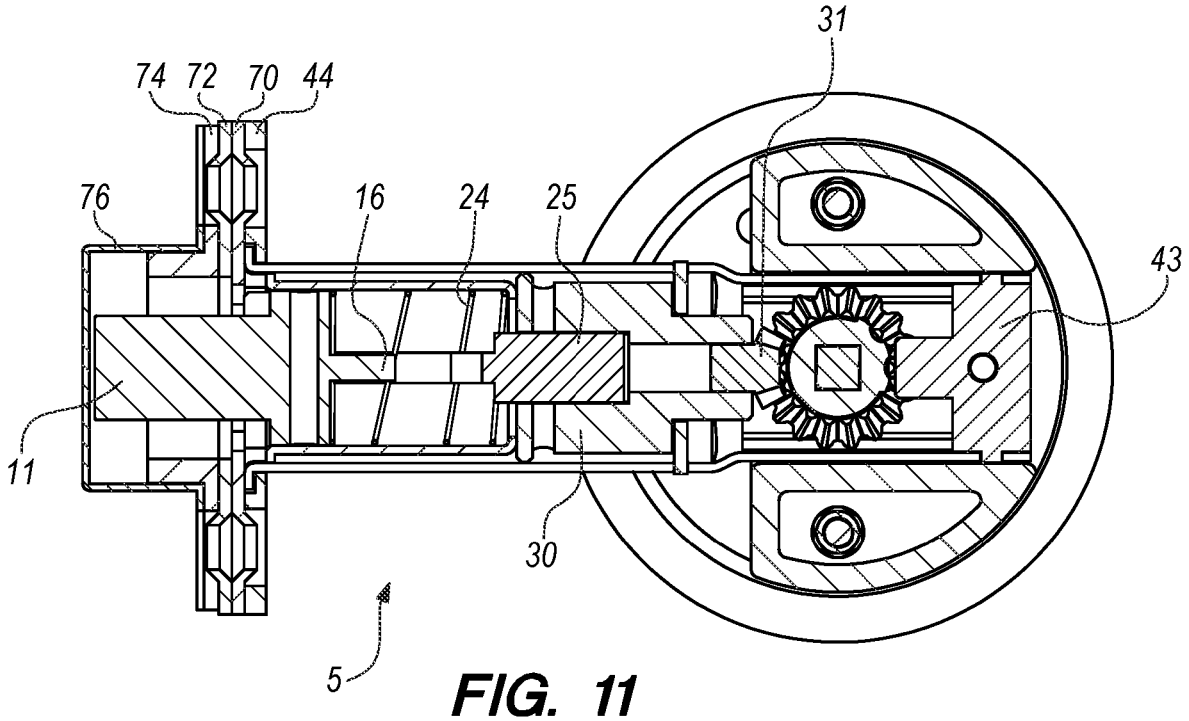
FIG. 11 is a cross sectional view of sliding door lockset with the sliding door closed and the winged latch bolt in the horizontal extended position.

To lock the door, the interior doorknob, door handle, or thumb turn 64 is rotated which rotates the spindle 60 which rotates the spindle hub 33 which rotates the latch bolt gear 31 which rotates the latch bolt housing 29 which rotates the winged latch bolt 11. Over rotation of the winged latch bolt 11 is prevented when the first collar tab 19 on latch bolt collar 18 contacts the second tab 46 on cylinder face plate 44, as depicted in FIG. 14, which stops rotation of the whole cylinder assembly with rotating winged latch bolt 40 and the door, the interior doorknob, door handle, or thumb turn 64. Over rotation is also prevented when the second collar tab 20 on latch bolt collar 18 contacts the first tab 46 on cylinder face plate 44, as depicted in FIG. 14, which stops rotation of the whole cylinder assembly with rotating winged latch bolt 40 and the door, the interior doorknob, door handle, or thumb turn 64. This position is depicted in FIGS. 7 and 11. As shown, the door face plate 70 and the strike plate 72 are adjacent and in contact with each other because the sliding door is closed. FIG. 7 depicts this position in an imaginary view where the dust box 76 has been separated from the strike plate 72 to show the position and orientation of the strike plate 72 and the winged latch bolt 11. This is the locked position because winged latch bolt 11 is in the horizontal position where the first and second wings 12,13 on winged latch bolt 11 cannot pass back out through the latch bolt hole in the strike plate 72 without contacting the strike plate 72 and catching on the latch bolt hole because the width of latch bolt hole in strike plate 72 is less than the distance from the tip of the first wing 12 to the tip of the second wing 13 on winged latch bolt 11. FIG. 14 also depicts this position, also in an imaginary view where the door face plate 70 has been removed to show the position and orientation of the first and second collar tabs 19,20 on latch bolt collar 18 and the first and second tabs 46,48 on cylinder face plate 44.

To unlock the door, the interior doorknob, door handle, or thumb turn 64 is rotated back which rotates the spindle 60 which rotates the spindle hub 33 which rotates the latch bolt gear 31 which rotates the whole latch bolt housing 29 which rotates the winged latch bolt 11. Over rotation is prevented when the first collar tab 19 on latch bolt collar 18 contacts the first tab 46 on cylinder face plate 44, as depicted in FIG. 13, which stops rotation of whole cylinder assembly with rotating winged latch bolt 40 and the door, the interior doorknob, door handle, or thumb turn 64. Over rotation is also prevented when the second collar tab 20 on latch bolt collar 18 contacts the second tab 48 on cylinder face plate 44, as depicted in FIG. 13, which stops rotation of the whole cylinder assembly with rotating winged latch bolt 40 and the door, the interior doorknob, door handle, or thumb turn 64. This position is depicted in FIGS. 5 and 10. As shown, the door face plate 70 and the strike plate 72 are adjacent and in contact with each other because the sliding door is closed. FIG. 6 also depicts this position, but in an imaginary view where the dust box 76 has been separated from the strike plate 72 to show the position and orientation of the strike plate 72 and the winged latch bolt 11. This is the unlocked position because winged latch bolt 11 is in the vertical position where the first and second wings 12,13 on winged latch bolt 11 can pass back out through the latch bolt hole in the strike plate 72 without contacting the strike plate 72 and catching on the latch bolt hole because the height of latch bolt hole in strike plate 72 is greater than the distance from the tip of the first wing 12 to the tip of the second wing 13 on winged latch bolt 11. FIG. 13 also depicts this position, also in an imaginary view where the door face plate 70 has been removed to show the position and orientation of the first and second collar tabs 19,20 on latch bolt collar 18 and the first and second tabs 46,48 on cylinder face plate 44.

To open the door, the sliding door is slid open and slid into its pocket in the door jamb that is located opposite from the door jamb with the strike plate 72. In the open position, the winged latch bolt is kept in the vertical retracted position. This position is depicted in FIGS. 4 and 9. As shown, the door face plate 70 and the strike plate 72 are separated because the sliding door is open. FIG. 13 also depicts this position, but in an imaginary view where the door face plate 70 has been removed to show the position and orientation of the first and second collar tabs 19,20 on latch bolt collar 18 and the first and second tabs 46,48 on cylinder face plate 44.

The winged latch bolt 11 may then be returned to the retracted position by pressing the winged latch bolt 11 inward to push lock tongue 16 on winged latch bolt 11 into latch bolt catch 25 which causes the latch bolt catch 25 to latch onto and hold lock tongue 16 therein causing the winged latch bolt 11 to be held in the retracted position by the latch bolt catch 25. This position is depicted in FIGS. 3 and 8. As shown, the door face plate 70 and the strike plate 72 are separated because the sliding door is open. FIG. 12 also depicts this position, but in an imaginary view where the door face plate 70 has been removed to show the position and orientation of the first and second collar tabs 19,20 on latch bolt collar 18 and the first and second tabs 46,48 on cylinder face plate 44.

What is claimed is:

1. A rotating winged latch bolt assembly comprising: a winged latch bolt; a latch bolt collar; a latch bolt collar pin; a latch bolt spring; a latch bolt catch; a latch bolt housing; a latch bolt hub; and a latch bolt gear, wherein, said winged latch bolt is a solid rigid cylindrical member with a first end, a second end, an exterior surface, an outside diameter, a length, a longitudinal axis, and a first wing, said first wing protrudes outward from said first end of said winged latch bolt, said first wing is a rigid protrusion that extends outward from said first end of said winged latch bolt, at a right angle to said longitudinal axis of said winged latch bolt, said first wing has a length, a longitudinal axis, a width, and a latitudinal axis, said length and said longitudinal axis of said first wing extends outward at a right angle to said longitudinal axis of said winged latch bolt, said width and said latitudinal axis of said first wing run perpendicular to said length of said first wing, said winged latch bolt further comprises a lock tongue protruding outward from said second end, said lock tongue is a rigid protrusion with a first end, a second end, and a longitudinal axis, said longitudinal axis of said lock tongue is coincident with said longitudinal axis of said winged latch bolt, said first end of said lock tongue is rigidly attached to said second of said winged latch bolt, said second end of lock tongue has a first tab and a second tab that each protrude outward from said second end of said lock tongue, said first tab is a rigid planar member that protrudes outward, at a right angle to said longitudinal axis of said lock tongue, said second tab is a rigid planar member that protrudes outward, at a right angle to said longitudinal axis of said lock tongue, and parallel with said longitudinal axis of said first tab, said winged latch bolt further comprises a pin hole adjacent to said second end of said winged latched bolt wherein said pin hole is a cylindrical hole with an inside diameter and a longitudinal axis running perpendicular to said longitudinal axis of said winged latch bolt, said latch bolt collar is a rigid hollow cylindrical member with a first end, a second end, a side, an inside diameter, an outside diameter, a length, and a longitudinal axis, said first end of said latch bolt collar is open with a first collar tab and a second collar tab, wherein, said first collar tab is a portion of said side of said latch bolt collar that extends beyond its two adjacent side portions to form a crenellation shaped member or square tab member extending from said first end of said latch bolt collar, said second collar tab is a portion of said side of said latch bolt collar that extends beyond its two adjacent side portions to form a crenellation shaped member or square tab member extending from said first end of said latch bolt collar that is directly opposite to said first collar tab, along the bisect of said latch bolt collar, said second end of said latch bolt collar is open and without any tabs, said latch bolt collar further comprises a first pin hole running through said side of said latch bolt collar wherein said pin hole is a cylindrical hole with an inside diameter and a longitudinal axis, said latch bolt collar further comprises a second pin hole running through said side of said latch bolt collar, directly across from said first pin hole, wherein said pin hole is a cylindrical hole with an inside diameter equivalent to that of said first pin hole and a longitudinal axis parallel to that of said first pin hole, said latch bolt collar pin is a solid rigid cylindrical member with a first end, a second end, an outside diameter, and a length, said latch bolt collar pin functions to attach said latch bolt collar to said winged latch bolt, said latch bolt spring is a coil spring or helical spring with a first end, a second end, an inside diameter, an outside diameter, a length, and a longitudinal axis, said latch bolt spring functions to apply continuous force or pressure that pushes said winged latch bolt outward to continuously push said winged latch bolt into an extended position, said latch bolt catch is a means to catch and hold said lock tongue when pressed and a means to release said lock tongue when pressed again, said latch bolt housing is a rigid hollow cylindrical member with a first end, a side, a second end, an inside diameter, an outside diameter, a length, and a longitudinal axis, said latch bolt housing further comprises a first slot and a second slot, wherein, each said slot is a slot, channel, or oblong void running longitudinally along said side of said latch bolt housing with a length and a width, said latch bolt hub is a rigid disc shaped member or cylindrical shaped member with a first end, a second end, a diameter, a center, and a longitudinal axis, said latch bolt hub further comprises a pin hole running through said diameter of said latch bolt hub, adjacent to said second side of said latch bolt hub, wherein said pin hole is a cylindrical hole with an inside diameter and a longitudinal axis, said latch bolt gear is a gear or cogwheel with a plurality teeth or ridges that project radially outward, said latch bolt gear has a first side, a second side, a diameter, a center, and a center axis, said latch bolt gear further comprises a pin hole running through said diameter of said latch bolt gear, adjacent to said first side of said latch bolt gear, wherein said pin hole is a cylindrical hole with an inside diameter and a longitudinal axis, said second side of said latch bolt gear has said plurality of teeth or ridges, said latch bolt gear pin is a solid rigid cylindrical member with a first end, a second end, an outside diameter, and a length, said outside diameter of said winged latch bolt is sized to make a slip fit with said inside diameter of said latch bolt housing, said outside diameter of said latch bolt collar is sized to make a slip fit with said inside diameter of said latch bolt housing, said inside diameter of said latch bolt collar is sized to make a slip fit over said outside diameter of said winged latch bolt, said outside diameter of latch bolt collar pin is sized to make a slip fit or press fit with said inside diameter of said pin hole on said winged latch bolt, said outside diameter of latch bolt collar pin is sized to make a slip fit or press fit with said inside diameters of said first and second pin holes on said winged latch bolt collar, said outside diameter of said latch bolt spring is sized to make a slip fit with said inside diameter of said latch bolt housing, said width of said first slot and said width of second slot on said latch bolt housing are sized to make a slip fit with said outside diameter of said latch bolt collar pin, said outside diameter of said latch bolt gear pin is sized to make a slip fit or press fit with said inside diameter of said pin hole on said latch bolt hub, said outside diameter of said latch bolt gear pin is sized to make a slip fit or press fit with said inside diameter of said pin hole on said latch bolt gear, said second end of said latch bolt housing is rigidly attached to said first end of said latch bolt hub said latch bolt catch is located inside said latch bolt housing and rigidly attached to said first side of said latch bolt hub, said second end of latch bolt spring is located inside said latch bolt housing, contiguous with and in contact with said first side of said latch bolt hub, said second end of said latch bolt collar is located inside said latch bolt housing, contiguous with and in contact with said first end of said latch bolt spring, said second end of said winged latch bolt is inserted into said first end of said latch bolt collar and positioned so that each end of said pin hole on said winged latch bolt are each aligned with said first pin hole and second pin holes on said latch bolt collar, which are also aligned with said first and second slots on said latch bolt housing, whereupon said latch bolt collar pin is inserted through all said pin holes to attach said latch bolt collar to said winged latch bolt and slideably attach said latch bolt collar and said winged latch bolt to said latch bolt housing, and said first side of said latch bolt gear is aligned with said second end of said latch bolt rotating so that said pin hole in said latch bolt gear is aligned with said pin hole in said latch bolt hub and said latch bolt gear pin is inserted there through to attach these members.

2. A cylinder assembly with rotating winged latch bolt comprising: a winged latch bolt assembly; a spindle hub; a spindle hub gear; a retaining ring; a first cylinder housing half; a second cylinder housing half; a cylinder housing cap; and a cylinder face plate, wherein, said winged latch bolt assembly is as recited in claim 1, said spindle hub is rigid cylindrical shaped member with a first end, a second end, a side, a diameter, a center, and a longitudinal axis, said spindle hub further comprises a spindle keyhole with a longitudinal axis that is coincident with that of said spindle hub, said spindle keyhole is a keyhole or square hole with a square or rectangular shaped cross section, said spindle keyhole functions to receive said spindle, which functions as a key or wrench that forms a slip-fit within said spindle keyhole, so that said spindle hub rotates as said spindle is rotated, said spindle hub gear is a gear or cogwheel with a plurality of teeth or ridges that project radially outward, said spindle hub gear meshes, mates, or couples with said latch bolt gear and functions to transmit torque from said spindle 60 to said winged latch bolt assembly, said spindle hub gear has a first side, a second side, a diameter, a center, and a center axis running perpendicular to said first and second sides, said second side of said spindle hub gear has said plurality of teeth or ridges, said plurality of said teeth or ridges on said spindle hub gear mesh with or couple with said plurality of teeth or ridges on said second side of said latch bolt gear, said center axis of said spindle hub gear runs perpendicular to that of said latch bolt gear wherein said spindle hub gear and said latch bolt gear mesh, mate, or couple together at a right angle to each other, said diameter of said spindle hub gear is equal to or greater than that of said latch bolt gear, said retaining ring is a rigid ring shaped member or rigid annular shaped member with an inside diameter and an outside diameter, said retaining ring functions to retain said winged latch bolt assembly within said first and second housing halves, said first cylinder housing half is one half of a rigid hollow cylindrical member split longitudinally down its center, said first cylinder housing half is a housing member that pairs with said second cylinder housing half to form a complete cylindrical shaped housing for said cylinder assembly with rotating winged latch bolt, said first cylinder housing half has a first end, a second end, an inside diameter, an outside diameter, a length, and a longitudinal axis, said inside diameter of said first cylinder housing half is sized slightly larger than said outside diameter of said latch bolt housing, said first cylinder housing half has a screw hole adjacent to said second end of said first cylinder housing half, said first cylinder housing half has a spindle clearance hole located in between said first end and said screw hole of said first cylinder housing half, said spindle clearance hole has a diameter and a center, said second cylinder housing half is one half of a rigid hollow cylindrical member split longitudinally down its center, said second cylinder housing half is a housing member that pairs with said first cylinder housing half to form a complete cylindrical shaped housing for said cylinder assembly with rotating winged latch bolt, said second cylinder housing half has a first end, a second end, an inside diameter, an outside diameter, a length, and a longitudinal axis, said inside diameter of said second cylinder housing half is sized slightly larger than said outside diameter of said latch bolt housing, said second cylinder housing half 42 has a screw hole adjacent to said second end of said second cylinder housing half, said second cylinder housing half has a spindle clearance hole located in between said first end and said screw hole of said second cylinder housing half, said spindle clearance hole has a diameter and a center, said cylinder housing cap is a rigid disc-shaped, circular-shaped, square-shaped, or rectangular-shaped member with an interior surface, an exterior surface end, and a center, said cylinder housing cap has a first edge, a second edge, a third edge, and a fourth edge, said first edge and said second edge of said cylinder housing cap each have a tapped hole, said cylinder face plate is a rigid vertical rectangular-shaped planar member with an exterior surface, an interior surface, a center, an upper edge, a lower edge, a first edge, a second edge, a latch bolt hole, a first screw hole, and a second screw hole, said latch bolt hole is a hole or void running through said center of said cylinder face plate, said latch bolt hole functions to provide a clearance space for said winged latch bolt to extend and retract there through, said latch bolt hole has radiused or curved side or edge with a first tab and a second tab, said first tab is a rigid planar protrusion that extends inward from said side or edge of said latch bolt hole and protrudes inward from said side or edge of said latch bolt hole, said first tab has a width and height, said first tab is located at a point on said side or edge of said latch bolt hole that is closest to said first edge of said cylinder face plate, said first tab functions to provide a mechanical stop or abutment for said first collar tab on said latch bolt collar, said second tab is a rigid planar protrusion that extends inward from said side or edge of said latch bolt hole and protrudes inward from said side or edge of said latch bolt hole, said second tab has a width and height, said second tab is located at a point on said side or edge of said latch bolt hole that is closest to said second edge of said cylinder face plate, directly opposite from said first tab, said second tab functions to provide a mechanical stop or abutment for said second collar tab on said latch bolt collar, said first screw hole on said cylinder face plate is a screw clearance hole located above said latch bolt hole, said second screw hole on said cylinder face plate is a screw clearance hole located below said latch bolt hole, said spindle hub is rigidly attached to said spindle hub gear wherein said second side of said latch bolt gear is adjacent to said first side of said spindle hub and said center axes of said latch bolt gear and said spindle hub are coincident, said spindle hub and said spindle hub gear are located within said first cylinder housing half with said longitudinal axes of said latch bolt gear and said spindle hub coincident with said center of said spindle clearance hole on said first cylinder housing half, said cylinder housing cap is located on said second end of said first cylinder housing half with said interior surface of said cylinder housing cap facing said first end of said first cylinder housing half and said exterior surface of said cylinder housing cap is flush with said second end of said first cylinder housing half, said rotating winged latch bolt assembly is located into said first cylinder housing half with said winged latch bolt in a vertical retracted position, said retaining ring is positioned over said latch bolt hub and said latch bolt gear at said second end of said latch bolt housing said latch bolt gear is positioned adjacent to said spindle hub gear and married to said spindle hub gear so that said plurality of teeth or ridges on said latch bolt gear are weaved or meshed into or entwined with said plurality of teeth or ridges on said spindle hub gear wherein said retaining ring also slides into a groove in said interior surface of said first cylinder housing half, said second cylinder housing half is located onto said first cylinder housing half with said first ends of each adjacent to each other and said second ends of each adjacent to each other, a screw or bolt is used to fasten said first cylinder housing half to said tapped hole on said first edge of said cylinder housing cap and another screw or bolt is used to fasten said second cylinder housing half to said tapped hole on said third edge of cylinder housing cap, said cylinder face plate is located over said first ends of said first and second cylinder housing halves so that said center of said latch bolt hole is coincident with said longitudinal axis of said winged latch bolt with said first collar tab on said latch bolt collar weaved between said first and second tabs on said cylinder face plate and said second collar tab on said latch bolt collar weaved between said first and second tabs on said cylinder face plate, and said cylinder face plate is rigidly attached to said first ends of said first and second cylinder housing halves.

3. A sliding door cylinder lockset comprising: a cylinder assembly with rotating winged latch bolt; a male cylinder bracket; a female cylinder bracket; an interior rose; an exterior rose; a spindle, two screws or bolts, and two nuts, wherein, said cylinder assembly with rotating winged latch bolt is as recited in claim 2, said male cylinder bracket is a bracket that holds said cylinder assembly with rotating winged latch bolt within a sliding door, said male cylinder bracket is a rigid member with an inner side, an outer side, and a center hole, said female cylinder bracket is a bracket that mates with said male cylinder bracket and holds said cylinder assembly with rotating winged latch bolt 40 within said sliding door, said female cylinder bracket is a rigid member with an inner side, an outer side, and a center hole, said spindle is a rigid solid rectangular cuboid member with a first end, a second end, and a longitudinal axis, said interior rose is a rigid planar member with an inner side, an outer side, and a center hole, said exterior rose is a rigid planar member with an inner side, an outer side, and a center hole, said interior trim is a rigid planar member with an inner side, an outer side, and a center hole, said exterior trim is a rigid planar member with an inner side, an outer side, and a center hole, said cylinder assembly with rotating winged latch bolt is located within a cavity in said sliding door, said inner side of said male cylinder bracket is positioned over said second cylinder housing half on said cylinder assembly with rotating winged latch bolt, said inner side of said female cylinder bracket is positioned over said first cylinder housing half on said cylinder assembly with rotating winged latch bolt, said inner side of said interior rose is placed against said outer side of said male cylinder bracket, said inner side of said exterior rose is placed against said outer side of said female cylinder bracket, said two screws or bolts are installed through said interior rose and said male cylinder bracket to mate with said two nuts installed through said exterior rose and said female cylinder bracket to attach these members to said sliding door, and said first end of said spindle is inserted through said center hole of said interior rose and through said spindle keyhole on said spindle hub gear, and then out of said center hole on said exterior rose, or said first end of said spindle is inserted through said center hole of said exterior rose and through said spindle keyhole on said spindle hub gear, and then out of said center hole on interior rose.

4. A rotating winged latch bolt assembly comprising: a winged latch bolt; a latch bolt collar; a latch bolt collar pin; a latch bolt spring; a latch bolt catch; a latch bolt housing; a latch bolt hub; and a latch bolt gear, wherein, said winged latch bolt is a solid rigid cylindrical member with a first end, a second end, an exterior surface, an outside diameter, a length, a longitudinal axis, a first wing, and a second wing, said first wing and said second wing each protrude outward from said first end of said winged latch bolt, said first wing is a rigid protrusion that extends outward from said first end of said winged latch bolt, at a right angle to said longitudinal axis of said winged latch bolt, said first wing has a length, a longitudinal axis, a width, and a latitudinal axis, said length and said longitudinal axis of said first wing extends outward at a right angle to said longitudinal axis of said winged latch bolt, said width and said latitudinal axis of said first wing run perpendicular to said length of said first wing, said second wing is a rigid protrusion that extends outward from said first end of said winged latch bolt, at a right angle to said longitudinal axis said winged latch bolt, said second wing has a length, a longitudinal axis, a width, and a latitudinal axis, said length and said longitudinal axis of said second wing extends outward at a right angle to said longitudinal axis of said winged latch bolt and parallel with said length and said longitudinal axis of said first wing, said width dimension and said latitudinal axis of said second wing run perpendicular to said length of said second wing, said winged latch bolt further comprises a lock tongue protruding outward from said second end, said lock tongue is a rigid protrusion with a first end, a second end, and a longitudinal axis, said longitudinal axis of said lock tongue is coincident with said longitudinal axis of said winged latch bolt, said first end of said lock tongue is rigidly attached to said second of said winged latch bolt, said second end of lock tongue has a first tab and a second tab that each protrude outward from said second end of said lock tongue, said first tab is a rigid planar member that protrudes outward, at a right angle to said longitudinal axis of said lock tongue, said second tab is a rigid planar member that protrudes outward, at a right angle to said longitudinal axis of said lock tongue, and parallel with said longitudinal axis of said first tab, said winged latch bolt further comprises a pin hole adjacent to said second end of said winged latched bolt wherein said pin hole is a cylindrical hole with an inside diameter and a longitudinal axis running perpendicular to said longitudinal axis of said winged latch bolt, said latch bolt collar is a rigid hollow cylindrical member with a first end, a second end, a side, an inside diameter, an outside diameter, a length, and a longitudinal axis, said first end of said latch bolt collar is open with a first collar tab and a second collar tab, wherein, said first collar tab is a portion of said side of said latch bolt collar that extends beyond its two adjacent side portions to form a crenellation shaped member or square tab member extending from said first end of said latch bolt collar, said second collar tab is a portion of said side of said latch bolt collar that extends beyond its two adjacent side portions to form a crenellation shaped member or square tab member extending from said first end of said latch bolt collar that is directly opposite to said first collar tab, along the bisect of said latch bolt collar, said second end of said latch bolt collar is open and without any tabs, said latch bolt collar further comprises a first pin hole running through said side of said latch bolt collar wherein said pin hole is a cylindrical hole with an inside diameter and a longitudinal axis, said latch bolt collar further comprises a second pin hole running through said side of said latch bolt collar, directly across from said first pin hole, wherein said pin hole is a cylindrical hole with an inside diameter equivalent to that of said first pin hole and a longitudinal axis parallel to that of said first pin hole, said latch bolt collar pin is a solid rigid cylindrical member with a first end, a second end, an outside diameter, and a length, said latch bolt collar pin functions to attach said latch bolt collar to said winged latch bolt, said latch bolt spring is a coil spring or helical spring with a first end, a second end, an inside diameter, an outside diameter, a length, and a longitudinal axis, said latch bolt spring functions to apply continuous force or pressure that pushes said winged latch bolt outward to continuously push said winged latch bolt into an extended position, said latch bolt catch is a means to catch and hold said lock tongue when pressed and a means to release said lock tongue when pressed again, said latch bolt housing is a rigid hollow cylindrical member with a first end, a side, a second end, an inside diameter, an outside diameter, a length, and a longitudinal axis, said latch bolt housing further comprises a first slot and a second slot, wherein, each said slot is a slot, channel, or oblong void running longitudinally along said side of said latch bolt housing with a length and a width, said latch bolt hub is a rigid disc shaped member or cylindrical shaped member with a first end, a second end, a diameter, a center, and a longitudinal axis, said latch bolt hub further comprises a pin hole running through said diameter of said latch bolt hub, adjacent to said second side of said latch bolt hub, wherein said pin hole is a cylindrical hole with an inside diameter and a longitudinal axis, said latch bolt gear is a gear or cogwheel with a plurality teeth or ridges that project radially outward, said latch bolt gear has a first side, a second side, a diameter, a center, and a center axis, said latch bolt gear further comprises a pin hole running through said diameter of said latch bolt gear, adjacent to said first side of said latch bolt gear, wherein said pin hole is a cylindrical hole with an inside diameter and a longitudinal axis, said second side of said latch bolt gear has said plurality of teeth or ridges, said latch bolt gear pin is a solid rigid cylindrical member with a first end, a second end, an outside diameter, and a length, said outside diameter of said winged latch bolt is sized to make a slip fit with said inside diameter of said latch bolt housing, said outside diameter of said latch bolt collar is sized to make a slip fit with said inside diameter of said latch bolt housing, said inside diameter of said latch bolt collar is sized to make a slip fit over said outside diameter of said winged latch bolt, said outside diameter of latch bolt collar pin is sized to make a slip fit or press fit with said inside diameter of said pin hole on said winged latch bolt, said outside diameter of latch bolt collar pin is sized to make a slip fit or press fit with said inside diameters of said first and second pin holes on said winged latch bolt collar, said outside diameter of said latch bolt spring is sized to make a slip fit with said inside diameter of said latch bolt housing, said width of said first slot and said width of second slot on said latch bolt housing are sized to make a slip fit with said outside diameter of said latch bolt collar pin, said outside diameter of said latch bolt gear pin is sized to make a slip fit or press fit with said inside diameter of said pin hole on said latch bolt hub, said outside diameter of said latch bolt gear pin is sized to make a slip fit or press fit with said inside diameter of said pin hole on said latch bolt gear, said second end of said latch bolt housing is rigidly attached to said first end of said latch bolt hub said latch bolt catch is located inside said latch bolt housing and rigidly attached to said first side of said latch bolt hub, said second end of latch bolt spring is located inside said latch bolt housing, contiguous with and in contact with said first side of said latch bolt hub, said second end of said latch bolt collar is located inside said latch bolt housing, contiguous with and in contact with said first end of said latch bolt spring, said second end of said winged latch bolt is inserted into said first end of said latch bolt collar and positioned so that each end of said pin hole on said winged latch bolt are each aligned with said first pin hole and second pin holes on said latch bolt collar, which are also aligned with said first and second slots on said latch bolt housing, whereupon said latch bolt collar pin is inserted through all said pin holes to attach said latch bolt collar to said winged latch bolt and slideably attach said latch bolt collar and said winged latch bolt to said latch bolt housing, and said first side of said latch bolt gear is aligned with said second end of said latch bolt rotating so that said pin hole in said latch bolt gear is aligned with said pin hole in said latch bolt hub and said latch bolt gear pin is inserted there through to attach these members.

5. A cylinder assembly with rotating winged latch bolt comprising: a winged latch bolt assembly; a spindle hub; a spindle hub gear; a retaining ring; a first cylinder housing half; a second cylinder housing half; a cylinder housing cap; and a cylinder face plate, wherein, said winged latch bolt assembly is as recited in claim 4, said spindle hub is rigid cylindrical shaped member with a first end, a second end, a side, a diameter, a center, and a longitudinal axis, said spindle hub further comprises a spindle keyhole with a longitudinal axis that is coincident with that of said spindle hub, said spindle keyhole is a keyhole or square hole with a square or rectangular shaped cross section, said spindle keyhole functions to receive said spindle, which functions as a key or wrench that forms a slip-fit within said spindle keyhole, so that said spindle hub rotates as said spindle is rotated, said spindle hub gear is a gear or cogwheel with a plurality of teeth or ridges that project radially outward, said spindle hub gear meshes, mates, or couples with said latch bolt gear and functions to transmit torque from said spindle 60 to said winged latch bolt assembly, said spindle hub gear has a first side, a second side, a diameter, a center, and a center axis running perpendicular to said first and second sides, said second side of said spindle hub gear has said plurality of teeth or ridges, said plurality of said teeth or ridges on said spindle hub gear mesh with or couple with said plurality of teeth or ridges on said second side of said latch bolt gear, said center axis of said spindle hub gear runs perpendicular to that of said latch bolt gear wherein said spindle hub gear and said latch bolt gear mesh, mate, or couple together at a right angle to each other, said diameter of said spindle hub gear is equal to or greater than that of said latch bolt gear, said retaining ring is a rigid ring shaped member or rigid annular shaped member with an inside diameter and an outside diameter, said retaining ring functions to retain said winged latch bolt assembly within said first and second housing halves, said first cylinder housing half is one half of a rigid hollow cylindrical member split longitudinally down its center, said first cylinder housing half is a housing member that pairs with said second cylinder housing half to form a complete cylindrical shaped housing for said cylinder assembly with rotating winged latch bolt, said first cylinder housing half has a first end, a second end, an inside diameter, an outside diameter, a length, and a longitudinal axis, said inside diameter of said first cylinder housing half is sized slightly larger than said outside diameter of said latch bolt housing, said first cylinder housing half has a screw hole adjacent to said second end of said first cylinder housing half, said first cylinder housing half has a spindle clearance hole located in between said first end and said screw hole of said first cylinder housing half, said spindle clearance hole has a diameter and a center, said second cylinder housing half is one half of a rigid hollow cylindrical member split longitudinally down its center, said second cylinder housing half is a housing member that pairs with said first cylinder housing half to form a complete cylindrical shaped housing for said cylinder assembly with rotating winged latch bolt, said second cylinder housing half has a first end, a second end, an inside diameter, an outside diameter, a length, and a longitudinal axis, said inside diameter of said second cylinder housing half is sized slightly larger than said outside diameter of said latch bolt housing, said second cylinder housing half 42 has a screw hole adjacent to said second end of said second cylinder housing half, said second cylinder housing half has a spindle clearance hole located in between said first end and said screw hole of said second cylinder housing half, said spindle clearance hole has a diameter and a center, said cylinder housing cap is a rigid disc-shaped, circular-shaped, square-shaped, or rectangular-shaped member with an interior surface, an exterior surface end, and a center, said cylinder housing cap has a first edge, a second edge, a third edge, and a fourth edge, said first edge and said second edge of said cylinder housing cap each have a tapped hole, said cylinder face plate is a rigid vertical rectangular-shaped planar member with an exterior surface, an interior surface, a center, an upper edge, a lower edge, a first edge, a second edge, a latch bolt hole, a first screw hole, and a second screw hole, said latch bolt hole is a hole or void running through said center of said cylinder face plate, said latch bolt hole functions to provide a clearance space for said winged latch bolt to extend and retract there through, said latch bolt hole has radiused or curved side or edge with a first tab and a second tab, said first tab is a rigid planar protrusion that extends inward from said side or edge of said latch bolt hole and protrudes inward from said side or edge of said latch bolt hole, said first tab has a width and height, said first tab is located at a point on said side or edge of said latch bolt hole that is closest to said first edge of said cylinder face plate, said first tab functions to provide a mechanical stop or abutment for said first collar tab on said latch bolt collar, said second tab is a rigid planar protrusion that extends inward from said side or edge of said latch bolt hole and protrudes inward from said side or edge of said latch bolt hole, said second tab has a width and height, said second tab is located at a point on said side or edge of said latch bolt hole that is closest to said second edge of said cylinder face plate, directly opposite from said first tab, said second tab functions to provide a mechanical stop or abutment for said second collar tab on said latch bolt collar, said first screw hole on said cylinder face plate is a screw clearance hole located above said latch bolt hole, said second screw hole on said cylinder face plate is a screw clearance hole located below said latch bolt hole, said spindle hub is rigidly attached to said spindle hub gear wherein said second side of said latch bolt gear is adjacent to said first side of said spindle hub and said center axes of said latch bolt gear and said spindle hub are coincident, said spindle hub and said spindle hub gear are located within said first cylinder housing half with said longitudinal axes of said latch bolt gear and said spindle hub coincident with said center of said spindle clearance hole on said first cylinder housing half, said cylinder housing cap is located on said second end of said first cylinder housing half with said interior surface of said cylinder housing cap facing said first end of said first cylinder housing half and said exterior surface of said cylinder housing cap is flush with said second end of said first cylinder housing half, said rotating winged latch bolt assembly is located into said first cylinder housing half with said winged latch bolt in a vertical retracted position, said retaining ring is positioned over said latch bolt hub and said latch bolt gear at said second end of said latch bolt housing said latch bolt gear is positioned adjacent to said spindle hub gear and married to said spindle hub gear so that said plurality of teeth or ridges on said latch bolt gear are weaved or meshed into or entwined with said plurality of teeth or ridges on said spindle hub gear wherein said retaining ring also slides into a groove in said interior surface of said first cylinder housing half, said second cylinder housing half is located onto said first cylinder housing half with said first ends of each adjacent to each other and said second ends of each adjacent to each other, a screw or bolt is used to fasten said first cylinder housing half to said tapped hole on said first edge of said cylinder housing cap and another screw or bolt is used to fasten said second cylinder housing half to said tapped hole on said third edge of cylinder housing cap, said cylinder face plate is located over said first ends of said first and second cylinder housing halves so that said center of said latch bolt hole is coincident with said longitudinal axis of said winged latch bolt with said first collar tab on said latch bolt collar weaved between said first and second tabs on said cylinder face plate and said second collar tab on said latch bolt collar weaved between said first and second tabs on said cylinder face plate, and said cylinder face plate is rigidly attached to said first ends of said first and second cylinder housing halves.

6. A sliding door cylinder lockset comprising: a cylinder assembly with rotating winged latch bolt; a male cylinder bracket; a female cylinder bracket; an interior rose; an exterior rose; a spindle, two screws or bolts, and two nuts, wherein, said cylinder assembly with rotating winged latch bolt is as recited in claim 5, said male cylinder bracket is a bracket that holds said cylinder assembly with rotating winged latch bolt within a sliding door, said male cylinder bracket is a rigid member with an inner side, an outer side, and a center hole, said female cylinder bracket is a bracket that mates with said male cylinder bracket and holds said cylinder assembly with rotating winged latch bolt 40 within said sliding door, said female cylinder bracket is a rigid member with an inner side, an outer side, and a center hole, said spindle is a rigid solid rectangular cuboid member with a first end, a second end, and a longitudinal axis, said interior rose is a rigid planar member with an inner side, an outer side, and a center hole, said exterior rose is a rigid planar member with an inner side, an outer side, and a center hole, said interior trim is a rigid planar member with an inner side, an outer side, and a center hole, said exterior trim is a rigid planar member with an inner side, an outer side, and a center hole, said cylinder assembly with rotating winged latch bolt is located within a cavity in said sliding door, said inner side of said male cylinder bracket is positioned over said second cylinder housing half on said cylinder assembly with rotating winged latch bolt, said inner side of said female cylinder bracket is positioned over said first cylinder housing half on said cylinder assembly with rotating winged latch bolt, said inner side of said interior rose is placed against said outer side of said male cylinder bracket, said inner side of said exterior rose is placed against said outer side of said female cylinder bracket, said two screws or bolts are installed through said interior rose and said male cylinder bracket to mate with said two nuts installed through said exterior rose and said female cylinder bracket to attach these members to said sliding door, and said first end of said spindle is inserted through said center hole of said interior rose and through said spindle keyhole on said spindle hub gear, and then out of said center hole on said exterior rose, or said first end of said spindle is inserted through said center hole of said exterior rose and through said spindle keyhole on said spindle hub gear, and then out of said center hole on interior rose.

* * * * *